US008907199B1

(12) United States Patent
Dixon

(10) Patent No.: US 8,907,199 B1
(45) Date of Patent: Dec. 9, 2014

(54) MUSICAL INSTRUMENT PICKUP WITH HARD FERROMAGNETIC BACKPLATE

(71) Applicant: George J. Dixon, Socorro, NM (US)

(72) Inventor: George J. Dixon, Socorro, NM (US)

( * ) Notice: Subject to any disclaimer, the term of this patent is extended or adjusted under 35 U.S.C. 154(b) by 7 days.

(21) Appl. No.: 13/725,344

(22) Filed: Dec. 21, 2012

Related U.S. Application Data

(63) Continuation-in-part of application No. 12/940,478, filed on Nov. 5, 2010, now Pat. No. 8,415,551.

(60) Provisional application No. 61/579,499, filed on Dec. 22, 2011.

(51) Int. Cl.
*G10H 3/12* (2006.01)

(52) U.S. Cl.
USPC ..... 84/726; 84/728; 84/743

(58) Field of Classification Search
USPC ..... 84/725, 726, 728, 743
See application file for complete search history.

(56) References Cited

U.S. PATENT DOCUMENTS

| | | | | |
|---|---|---|---|---|
| 2,225,299 | A | | 12/1940 | Demuth |
| 2,235,983 | A | | 3/1941 | Demuth |
| 2,573,254 | A | | 10/1951 | Fender |
| 2,612,072 | A | | 9/1952 | de Armond |
| 2,612,541 | A | | 9/1952 | de Armond |
| 2,683,388 | A | | 7/1954 | Keller |
| 2,817,261 | A | | 12/1957 | Fender |
| 2,976,755 | A | | 1/1959 | Fender |
| 2,892,371 | A | | 6/1959 | Butts |
| 2,896,491 | A | | 7/1959 | Lover |
| 2,909,092 | A | | 10/1959 | De. Armond |
| 2,911,871 | A | | 11/1959 | Schultz |
| 2,933,967 | A | | 4/1960 | Riscol |
| 3,236,930 | A | | 2/1966 | Fender |
| 3,249,677 | A | | 5/1966 | Ormston |
| 3,541,219 | A | | 11/1970 | Abair |
| 3,571,483 | A | * | 3/1971 | Davidson ..... 84/726 |
| 3,588,311 | A | | 6/1971 | Zoller |
| 3,916,751 | A | | 11/1975 | Stich |
| 3,983,777 | A | | 10/1976 | Bartolini |
| 4,010,334 | A | | 3/1977 | Demeter |
| 4,184,398 | A | * | 1/1980 | Siegelman ..... 84/725 |
| 4,220,069 | A | * | 9/1980 | Fender ..... 84/726 |
| 4,283,982 | A | | 8/1981 | Armstrong |
| 4,320,681 | A | | 3/1982 | Altilio |
| 4,364,295 | A | | 12/1982 | Stich |
| 4,499,809 | A | * | 2/1985 | Clevinger ..... 84/726 |
| 4,501,185 | A | | 2/1985 | Blucher |

(Continued)

OTHER PUBLICATIONS

Hunter, Duncan, et al., "*The Guitar Pickup Handbook, the Start of Your Sound*" (Backbeat/Hal Leonard, New York, 2008). (total of 260 pages).

(Continued)

*Primary Examiner* — David S. Warren
(74) *Attorney, Agent, or Firm* — Leydig, Voit & Mayer, Ltd.

(57) ABSTRACT

A musical instrument pickup with hard ferromagnetic backplates that are coupled to self-magnetized pole pieces, thereby enabling the tonal parameters of the pickup to be varied over an extended range. The tonal range of pickups with composite pole pieces are extended by a hard ferromagnetic backplates and the tonal range of pickups with monolithic pole pieces are extended by backplates that are formed from hard ferromagnetic materials with coercivities in the range of 300 Oersteds to 1000 Oersteds.

27 Claims, 17 Drawing Sheets

(56) References Cited

U.S. PATENT DOCUMENTS

| | | | | |
|---|---|---|---|---|
| 4,524,667 | A | 6/1985 | Duncan | |
| 4,580,481 | A | 4/1986 | Schaller et al. | |
| 4,581,974 | A | 4/1986 | Fender | |
| 4,581,975 | A | 4/1986 | Fender | |
| 4,624,172 | A | 11/1986 | McDougall | |
| 4,686,881 | A * | 8/1987 | Fender | 84/727 |
| 4,907,483 | A * | 3/1990 | Rose et al. | 84/726 |
| 4,941,388 | A * | 7/1990 | Hoover et al. | 84/726 |
| 5,123,324 | A * | 6/1992 | Rose et al. | 84/726 |
| 5,168,117 | A * | 12/1992 | Anderson | 84/726 |
| 5,221,805 | A | 6/1993 | Lace | |
| 5,233,123 | A * | 8/1993 | Rose et al. | 84/726 |
| 5,290,968 | A * | 3/1994 | Mirigliano et al. | 84/726 |
| 5,292,998 | A * | 3/1994 | Knapp | 84/726 |
| 5,292,999 | A * | 3/1994 | Tumura | 84/728 |
| 5,336,845 | A * | 8/1994 | Lace, Sr. | 84/726 |
| 5,354,949 | A * | 10/1994 | Zwaan | 84/727 |
| 5,378,850 | A * | 1/1995 | Tumura | 84/727 |
| 5,389,731 | A * | 2/1995 | Lace | 84/726 |
| 5,391,831 | A * | 2/1995 | Lace | 84/726 |
| 5,399,802 | A * | 3/1995 | Blucher | 84/726 |
| 5,408,043 | A * | 4/1995 | Lace | 84/726 |
| 5,418,327 | A * | 5/1995 | Lace et al. | 84/743 |
| 5,422,432 | A * | 6/1995 | Lace | 84/726 |
| 5,430,246 | A * | 7/1995 | Lace et al. | 84/726 |
| 5,530,199 | A * | 6/1996 | Blucher | 84/728 |
| 5,610,357 | A * | 3/1997 | Frank-Braun | 84/726 |
| 5,668,520 | A | 9/1997 | Kinman | |
| 5,792,973 | A * | 8/1998 | Riboloff | 84/726 |
| 5,811,710 | A | 9/1998 | Blucher et al. | |
| 5,834,999 | A | 11/1998 | Kinman | |
| 5,894,101 | A * | 4/1999 | Damm | 84/728 |
| 5,932,827 | A * | 8/1999 | Osborne et al. | 84/726 |
| 5,949,014 | A * | 9/1999 | Rashak et al. | 84/725 |
| 6,103,966 | A * | 8/2000 | Kinman | 84/728 |
| 6,111,185 | A | 8/2000 | Lace | |
| 6,291,758 | B1 * | 9/2001 | Turner | 84/726 |
| 6,291,759 | B1 * | 9/2001 | Turner | 84/726 |
| 6,392,137 | B1 | 5/2002 | Isvan | |
| 6,846,981 | B2 * | 1/2005 | Devers | 84/728 |
| 6,998,529 | B2 | 2/2006 | Wnorowski | |
| 7,022,909 | B2 * | 4/2006 | Kinman | 84/726 |
| 7,166,793 | B2 * | 1/2007 | Beller | 84/723 |
| 7,189,916 | B2 * | 3/2007 | Kinman | 84/726 |
| 7,227,076 | B2 * | 6/2007 | Stich | 84/726 |
| 7,285,714 | B2 * | 10/2007 | Juszkiewicz et al. | 84/726 |
| 7,288,713 | B2 | 10/2007 | Krozack et al. | |
| 7,399,918 | B2 * | 7/2008 | Juszkiewicz et al. | 84/742 |
| 7,427,710 | B2 * | 9/2008 | Hara | 84/723 |
| 7,595,444 | B2 * | 9/2009 | Stewart | 84/728 |
| 7,718,886 | B1 * | 5/2010 | Lace | 84/727 |
| 7,989,690 | B1 * | 8/2011 | Lawing | 84/726 |
| 7,994,413 | B2 * | 8/2011 | Salo | 84/726 |
| 8,178,774 | B2 | 5/2012 | Salehi | |
| 8,471,137 | B2 * | 6/2013 | Adair et al. | 84/726 |
| 2001/0027716 | A1 * | 10/2001 | Turner | 84/726 |
| 2002/0020281 | A1 * | 2/2002 | Devers | 84/728 |
| 2002/0069749 | A1 * | 6/2002 | Hoover et al. | 84/738 |
| 2002/0083819 | A1 * | 7/2002 | Kinman | 84/726 |
| 2002/0092413 | A1 * | 7/2002 | Turner | 84/726 |
| 2003/0051596 | A1 * | 3/2003 | Gustafsson | 84/723 |
| 2003/0196538 | A1 * | 10/2003 | Katchanov et al. | 84/297 S |
| 2004/0003709 | A1 * | 1/2004 | Kinman | 84/728 |
| 2004/0139837 | A1 * | 7/2004 | Oskorep | 84/322 |
| 2005/0092159 | A1 * | 5/2005 | Oskorep | 84/322 |
| 2006/0112816 | A1 * | 6/2006 | Kinman | 84/728 |
| 2006/0150806 | A1 * | 7/2006 | Hara | 84/726 |
| 2006/0156911 | A1 | 7/2006 | Stich | |
| 2006/0174753 | A1 * | 8/2006 | Aisenbrey | 84/600 |
| 2006/0254405 | A1 * | 11/2006 | Bergman | 84/297 R |
| 2006/0275631 | A1 * | 12/2006 | Rosenberg | 429/8 |
| 2007/0017355 | A1 | 1/2007 | Lace | |
| 2007/0056435 | A1 * | 3/2007 | Juszkiewicz et al. | 84/726 |
| 2008/0245218 | A1 * | 10/2008 | Stewart | 84/727 |
| 2009/0320670 | A1 * | 12/2009 | Flum et al. | 84/723 |
| 2010/0005954 | A1 | 1/2010 | Higashidate | |
| 2010/0101399 | A1 | 4/2010 | Calvet | |
| 2010/0122623 | A1 * | 5/2010 | Salo | 84/726 |
| 2011/0100200 | A1 * | 5/2011 | Mayes | 84/726 |
| 2012/0210847 | A1 * | 8/2012 | Adair et al. | 84/726 |
| 2012/0210848 | A1 | 8/2012 | Yamanaka | |
| 2013/0239788 | A1 * | 9/2013 | Mills et al. | 84/726 |

OTHER PUBLICATIONS

Milan, Mario, "*Pickups, Windings and Magnets and the Guitar Became Electric*", (Centerstream, Anaheim Hills, 2007) (total of 216 pages).

French, Richard Mark, "*Engineering the Guitar, Theory and Practice*", (Springer, New York, 2009) (total of 274 pages).

Constantinides, Steve, "Semi-Hard Magnets, The important role of material with intermediate coercivity", presented at the *Magnetics 2011 Conference*, San Antonio, TX, Mar. 1-2, 2011 (27 pages total).

Bozworth, Richard M., "*Ferromagnetism*", (IEEE Press Piscataway, 1951, 1978).

Campbell, Peter, "*Permanent Magnetic Materials and their Application*", (Cambridge University Press, Cambridge 1994) (total of 218 pages).

Lawerence, Bill, "*Bridge Pickup Base Plates*", retrieved from http:www.tdpri.com/resourceBASEPLATE.htm on Dec. 6, 2011 (2 pages).

Lawerence, Bill, *How Would an Aluminum Bridge Plate Compare with other TeleBridge Plates*? retrieved from http://www.billawrence.com/Pages/ForTeleLovers.htm on Dec. 2, 2011. (2 pages).

Goldman, Alex, "*Modern Ferrite Technology*", 2nd Edition, (Springer, New York, 2006) Part 1 (total of 218 pages).

Goldman, Alex, "*Modern Ferrite Technology*", 2nd Edition, (Springer, New York, 2006) second part of CB (total pp. 218).

Errede, Professor Steven, Presentation entitled "Electronic Transducers for Musical Instruments". Department of Physics, The University of Illinois at Urban-Campaign, *AES Talk*, UIUC, Nov. 29, 2005 (43 pages).

Lemme, Helmuth E.W., "*The Secret of Electric Guitar Pickups*", 2009, updated Feb. 25, 2009, retrieved from http://buildyourguitar.com/resources/leme/ on May 10, 2009 ( 9 pages).

Sulzer, Mike, "*Music Electronics Forum*", retrieved from http://music-electronic-forum.com/t13930/ on Sep. 23, 2009 (9 pages total).

Article entitled Common Magnetic Terminology as Used in Specification and Claims of U.S. Appl. No. 12/940,478 retrieved from Wikipedia at http://en.wikipedia.org/wiki/magnet.

Article entitled Seymour Duncan Zephyr TM, The Next Great Sound of Guitar retrieved from http://www.seymourduncan.com/newproducts/zephyr-silver-pickups.php on Oct. 29, 2011 (2 pages).

Ressler, Phil, "Zephyr Silver Background", retrieved from http://www.symourduncan.com/forum/showthread.php?t=207793 on May 16, 2012 (15 pages).

Article entitled "This month we will try some new tone tailoring tricks", PremierGuitar, retrieved from http://www.premierguitar.com/Magazine/Issue/2007.Aug.Befing_Up_Single_Coil.aspx on Nov. 23, 2012 (3 pages total).

Article retrieved from http://www/seymourduncan.com/products/bass/pbas/passive/110441_pickup/ on Dec. 17, 2012 Antiguilty for P-Bass®: (twin coil)/11044-11-Seymour Duncan Passive ( 2 pages total).

Article retrieved from http://www.dimarzio.com/pickups/bass/standard-bass/ultra-jazz-pair, Ultra Jazz™ Pair/DiMarzio on Nov. 29, 2012 (2 pages total).

Lemarquand, G., et al., "Calculation Method of Permanent-Magnet Pickups for Electric Guitars", *IEEE Transactions on Magnetics*, vol. 43., No. 9, (Sep. 2007—pp. 3573-3578)

Horton, Nicholas G., et al., "Modeling the Magnetic Pickup of an Electric Guitar", *American Journal of Physics*, vol. 77, No. 2 (Feb. 2009—pp. 144-150).

Lemme, Helmuth, "Electric Guitar Sound Secrets and Technology", *Elector International Media BV 2012*, ISBN 978-1-907920-13-4 (Part 1—70 pages).

(56) References Cited

OTHER PUBLICATIONS

Lemme, Helmuth, "Electric Guitar Sound Secrets and Technology", *Elector International Media BV 2012*, ISBN 978-1-907920-13-4 (Part 2—69 pages).
Lemme, Helmuth, "Electric Guitar Sound Secrets and Technology", *Elector International Media BV 2012*, ISBN 978-1-907920-13-4 (Part 3—66 pages)
Lemme, Helmuth, "Electric Guitar Sound Secrets and Technology", *Elector International Media BV 2012*, ISBN 978-1-907920-13-4 (Part 4—74 pages).
Strnat, Karl J, "Modern Permanent Magnets for Applications in Electro-Technology", *Proceedings of the IEEE*, vol. 78, No. 6, Jun. 1990 (35 pages).
Bozorth, Richard M., "Ferromagnetism", (*IEEE Press/Wiley*, Hoboken, 2003) (Part 1—244 pages).
Bozorth, Richard M., "Ferromagnetism", (*IEEE Press/Wiley*, Hoboken, 2003) (Part 2—248 pages).
Bozorth, Richard M., "Ferromagnetism", (*IEEE Press/Wiley*, Hoboken, 2003) (Part 3—246 pages).
Bozorth, Richard M., "Ferromagnetism", (*IEEE Press/Wiley*, Hoboken, 2003) (Part 4—244 pages)
Cullity, B.D., et al., "Introduction to Magnetic Materials", *IEEE Press/Wiley*, Hoboken 2008, (Part 1—145 pages).
Cullity, B.D., et al., "Introduction to Magnetic Materials", *IEEE Press/Wiley*, Hoboken 2008, (Part 2—140 pages).
Cullity, B.D, et al., "Introduction to Magnetic Materials", *IEEE Press/Wiley*, Hoboken 2008, (Part 3—132 pages).
Cullity, B.D., et al., "Introduction to Magnetic Materials" *IEEE Press/Wiley*, Hoboken 2008, (Part 4—132 pages).
Constantinides, Steve, Presentation entitled "Designing with Thin Gauge", *SMMA Fall Technical Conference*, Oct. 2008, (55 pages).
Constantinides, Steve, Presentation entitled "*Undercover Magnets*", Iowa State University—MRS, Apr. 7, 2011 (44 pages).

* cited by examiner (A)

(B)

(C)

MUSICAL INSTRUMENT PICKUP WITH HARD FERROMAGNETIC BACKPLATE

CROSS-REFERENCE TO RELATED APPLICATION

This application is a continuation in part of Utility application Ser. No. 12/940,478, filed on Nov. 5, 2010 and claims the benefit of Provisional Application No. 61/579,499, filed on Dec. 22, 2011. Both applications are incorporated herein by reference in their entirety.

FIELD OF THE INVENTION

The present invention relates to pickups for sensing vibrations in a stringed musical instrument and, more specifically, to musical instrument pickups with magnetized pole pieces and hard ferromagnetic backplates.

BACKGROUND OF THE INVENTION

String motion sensors, commonly known as pickups, are installed on guitars, bass guitars, mandolins and other stringed musical instruments to convert the sound produced by the vibrating strings to an electronic signal. In various applications, the electronic signal generated by a pickup may be modified using analog and digital signal processing techniques, amplified, and recorded on a suitable sound recording medium before being converted back to a sound signal by a speaker or other output transducer. Conventional musical instrument pickups use different physical principles, including variations in magnetic reluctance, the Hall effect, and the piezoelectric effect, to detect the motion of ferromagnetic strings.

Magnetic reluctance pickups typically comprise one or more ferromagnetic pole pieces, at least one magnetic flux source that generates a magnetic flux in the pole pieces, and a coil with two or more output terminals that surrounds the pole pieces. In some designs, the pole pieces generate their own flux and are formed from hard ferromagnetic materials that are magnetized as permanent magnets. In alternative designs the flux is generated by permanent magnets that are external to the pole pieces.

When the pickup is positioned near the ferromagnetic strings of a musical instrument the pole pieces induce a magnetic flux in the strings. The magnetic fluxes in the source, pole pieces and strings are mutually dependent and the magnetic flux in one or more of the pole pieces varies with string vibration. The coil surrounding the pole pieces links the flux in the pole pieces and an electromotive force is developed in the coil when the flux in the poles varies in response to string vibration. An electronic signal is developed at the output terminals of the coil in response to the electromotive force.

The frequency-dependent response function of a magnetic musical pickup is nonlinear and the audio frequency spectrum of a string's acoustic vibration is typically distorted by the pickup in the process of converting it to an electronic signal. This distortion is commonly referred to as the 'tone' of the pickup and, when properly controlled, adds desirable musical qualities to the output signal.

Magnetic musical instrument pickups may classified into broad categories that reflect differences in basic design and tonal quality. Pickups in the 'single coil' category have key design features that are shared by the pickups disclosed in U.S. Pat. No. 2,612,072 issued to H. de Armond on Sep. 30, 1952, U.S. Pat. No. 2,573,254, U.S. Pat. No. 2,817,261, U.S. Pat. No. 3,236,930, and U.S. Pat. No. 4,220,069 respectively issued to Leo Fender on Oct. 30, 1951, Dec. 24, 1957, Feb. 22, 1966, and Sep. 2, 1980 and U.S. Pat. No. 2,911,871 issued to C. F. Schultz on Nov. 10, 1959. The 'single coil' name derives from the fact that pickups in this category comprise a set of string-sensing ferromagnetic pole pieces with a magnetic flux that is linked by a single, string-sensing coil of wire. In some single coil pickups, the pole pieces are formed from magnetized hard ferromagnetic materials that generate the magnetic flux in the pickup. In other single coil designs one or more external permanent magnets are coupled to soft ferromagnetic pole pieces. Conventional single coil pickups have no means for external noise rejection and are sensitive to external electromagnetic noise sources.

The noise sensitivity of a pickup in which the pole pieces that sense the motion of a single string are surrounded by only one coil may be advantageously reduced by separating the pole pieces into two subsets (typically with equal numbers of poles) and surrounding each subset of poles with a different coil. By reversing the magnetic polarity of each subset of poles and causing the signal to traverse the coils in opposite directions, string-generated signals from the two coils may be summed and the noise-generated signals at least partially cancelled. Commercial examples of split coil pickups that employ this approach include the P-Bass pickup that is disclosed in U.S. Pat. No. 2,976,755 issued to C. L. Fender on Jan. 6, 1959 and Z-coil pickup that is manufactured and installed as original equipment on the Comanche model six string guitars manufactured by G&L Guitar Company of Fullerton, Calif.

Noise-reducing humbucking pickups or 'humbuckers' share key design features with the devices that are disclosed in U.S. Pat. No. 2,896,491 ('491) issued to Seth Lover on Jul. 28, 1959, U.S. Pat. No. 4,220,069 ('069) issued to C. Leo Fender on Sep. 2, 1980, and U.S. Pat. No. 2,892,371 ('371) issued to J. R. Butts on Jun. 30, 1959. Pickups in this class have at least two-string sensing coils, each linked to a separate set of string-sensing pole pieces. The magnetic field direction in the poles and the direction of signal propagation within the coils are selected so that a large portion of the string-generated signals from the two are coils have an in-phase, additive relationship and a large percentage of the common-mode noise signals from the two coils have an out-of-phase, subtractive relationship. In most cases, the amplitude of the output signal of a humbucking pickup is greater than that obtained from a single coil pickup and the output noise signal is significantly reduced.

Magnetic pickups have been developed for a wide variety of musical instruments. In addition to six string guitars, magnetic pickups are commonly used on other lute-type stringed instruments such as 12-string guitars, bass guitars, mandolins, and steel guitar. Magnetic pickups have also been developed for percussion instruments including marimbas, xylophones and pianos. The scope of the present invention is limited to lute-type instruments with ferromagnetic strings and, for purposes of clarity, the features of the present invention will be discussed with reference to a 6-string guitar. Those skilled in the art will, however, realize that the scope of the invention is not limited to the exemplary six string guitars with ferromagnetic strings but extends to a wide range of stringed musical instruments.

The design and manufacture of magnetic musical instrument pickups are described from an historical and lay engineering perspective in *The Guitar Pickup Handbook, the Start of Your Sound* by Duncan Hunter (Backbeat/Hal Leonard, New York, 2008) and *Pickups, Windings and Magnets and the Guitar Became Electric*, by Mario Milan (Centerstream, Anaheim Hills, 2007). On a more technical level, *Engineering the*

*Guitar, Theory and Practice* by Richard Mark French (Springer, New York, 2009) contains a chapter on Guitar Electronics and a thorough treatment of musical sound quality and tone as viewed from an engineering and physics perspective.

BRIEF SUMMARY OF THE INVENTION

Magnetic musical instrument pickups that embody the invention generate new and useful tones by combining hard ferromagnetic backplates and self-magnetizing pole pieces. Hard ferromagnetic backplates have attractive tonal properties that have been substantially unrecognized in the prior art.

In some embodiments, the invention comprises a set of two or more self-magnetized string sensing pole pieces that are coupled to a ferromagnetic plate with one or more components that are fabricated from a hysteresis material. The set of pole pieces is at least partially surrounded by a wire coil that links a magnetic flux in the pole pieces and generates an electrical signal in response to string-induced flux variations. The pole pieces, wire coil and ferromagnetic plate are held in stable position by a mount that provides a means for attaching the pickup to an instrument and, in some cases, the mount further comprises a set of electrical contacts that facilitate electrical connection to the ends of the wire coil.

The ferromagnetic plate may be partially or fully magnetized and, in some cases, the ferromagnetic properties of the ferromagnetic plate are a function of position in a plate that is approximately parallel to the lower surfaces of the pole pieces. Hysteresis materials are hard ferromagnetic materials with unique ferromagnetic properties that may be advantageously used to shape the tone of a pickup. Their resistance to demagnetization can be expressed numerically as a normal coercivity value and the coercivity of hysteresis materials is less than that of the rare earth and ceramic magnets and greater than that of carbon steels. In this application, hysteresis materials are defined as hard ferromagnetic materials with coercivities that are greater than or equal to 100 Oersteds and less than or equal to 1000 Oersteds. They may be incorporated into embodiments of the invention in various physical forms including powders or granulated particles in an insulating binder. The backplate may also have additional components that are formed from hard ferromagnetic materials, soft ferromagnetic materials or nonferromagnetic conductors.

The coupling between a hysteresis material backplate and one or more of the pole pieces may be adjusted by inserting a nonferromagnetic spacer between the pole pieces and the plate and/or causing the ferromagnetic properties of the plate to vary with position in a plane that is parallel to the lower surfaces of the pole pieces.

Self-magnetized pole pieces in hysteresis backplate embodiments of the invention may have monolithic or composite structures that may optionally comprise a hysteresis material component. In addition to a magnetized hard ferromagnetic component, composite pole pieces may also comprise components that are formed from hard ferromagnetic materials, soft ferromagnetic materials, or nonferromagnetic conductors.

Further hysteresis plate embodiments may comprise additional sets of pole pieces that are coupled to additional ferromagnetic plates. The additional pole piece sets may be surrounded by the same coil as the pole pieces that are coupled to the hysteresis material or they may be surrounded by a second coil. Additional pole piece sets may also be coupled to one or more hard ferromagnetic plates that may be formed from different materials than the plate comprising the hysteresis material. The additional plates may optionally comprise one or more hard ferromagnetic components. In additional embodiments, the set of pole pieces that is coupled to a hysteresis material backplate may be ferromagnetically coupled to one or more additional plates.

Pickups embodying the invention may also comprise a set of self-magnetized pole pieces that includes one or more composite pole pieces and a backplate with at least one hard ferromagnetic component. The ferromagnetic backplate component may be fabricated from any hard ferromagnetic material including, but not limited to, hysteresis materials and granular hard ferromagnetic materials that are optionally combined with other granular ferromagnetic materials in an insulating binder. An output signal is generated by a wire coil that links a magnetic flux in the set of pole pieces and a mounting structure holds the coil, backplate and set of pole pieces in stable relative positions.

Self-magnetizing composite pole pieces include a magnetized hard ferromagnetic component and additional components that may be formed from hard or soft ferromagnetic materials as described in U.S. patent application Ser. No. 12/940,478 ('478), which is hereby incorporated by reference in its entirety and for everything it teaches. The hard ferromagnetic pole component may be fabricated from a single material or it may be formed from a granular hysteresis material in an insulating binder. The self-magnetizing composite pole pieces may further include thin slices of ferromagnetic material, commonly known as pole caps, as their uppermost component.

In different embodiments, a pickup may comprise a second set of pole pieces that is at least partially surrounded by a second coil. The second coil may be connected to the coil that surrounds the composite pole piece and the magnetic polarity of the second set of pole pieces directed in noise-cancelling configurations that are similar to conventional P-bass and humbucking pickups and, in further embodiments, the second set of pole pieces may be ferromagnetically coupled to a second ferromagnetic plate.

In an additional group of embodiments, a magnetic pickup according to the invention comprises a set of self-magnetized pole pieces and a ferromagnetic backplate with at least one hysteresis material component that can be removed from the pickup or replaced with a backplate component having different ferromagnetic properties. Removing or exchanging the backplate component modifies the tone of the pickup, thereby allowing a user to optimize the tone for a particular application. The pickup further comprises a wire coil that links a magnetic flux in the pole pieces and a mounting structure that holds the coil, backplate and set of poles in a stable configuration. The hysteresis material component of the backplate may be formed from a wide range of different materials including those in which a hard ferromagnetic material is incorporated in an insulating binder.

DESCRIPTION OF THE EMBODIMENTS

Figure 1:
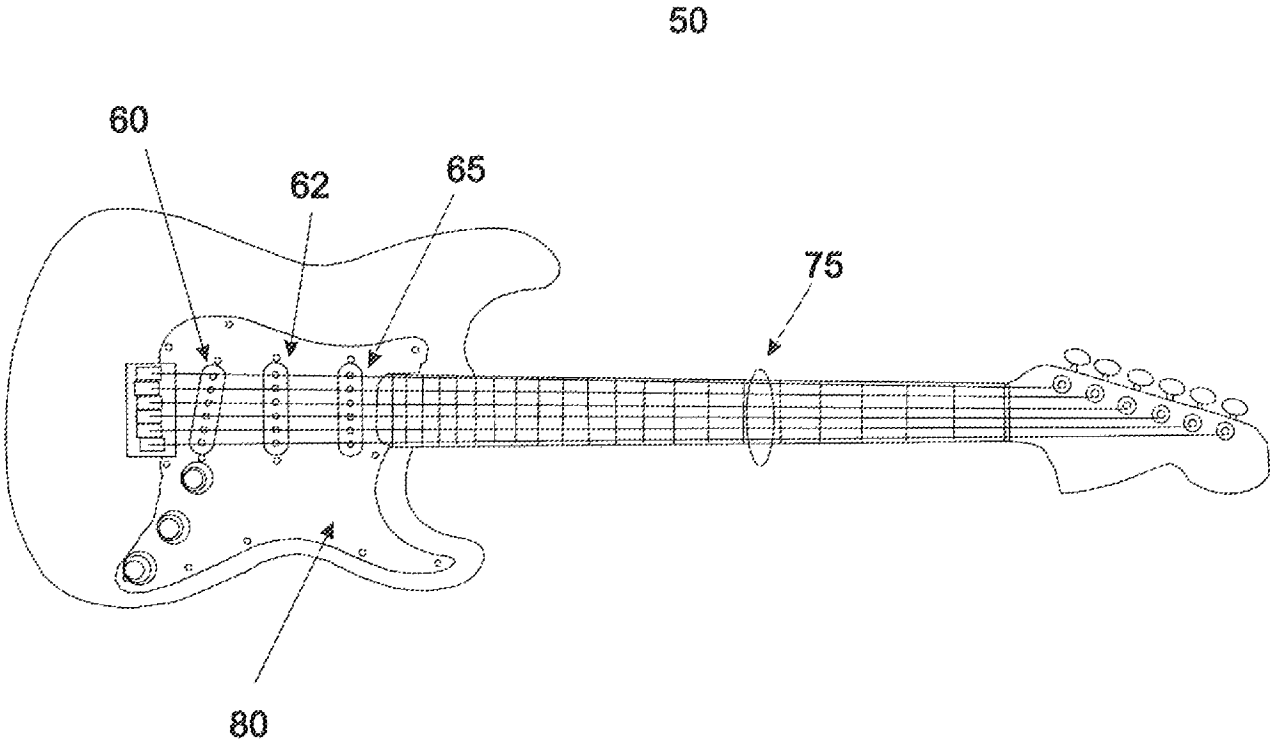
FIG. 1 is a front view of a guitar with six ferromagnetic strings and three magnetic pickups.

Magnetic musical instrument pickups are commonly used to sense the motion of ferromagnetic strings on a guitar, bass guitar, pedal steel guitar or other stringed musical instrument. FIG. 1 illustrates a representative Stratocaster-style guitar 50 with six ferromagnetic strings 75 and three magnetic pickups 60, 62, 65. In the guitar 50, the three magnetic pickups 60, 62, 65 generate an electronic output signal in response to the string vibrations and are mounted on a pickguard 80 with screws.

The amplitude and tonal features of the output signal generated by a pickup are dependent on its detailed design features. Typically, the fidelity with which the pickup output signal represents the spectrum of the string vibrations is not high and it is common practice to describe the pickup distortions by attributing a 'musical tone' or a 'tonal quality' to the device.

The terms 'musical tone,' and 'tonal quality' are commonly used by those skilled in the art of musical instrument and pickup design to refer to a set of physical parameters that determine the musical qualities of the sound emanating from an instrument or component as perceived by a human observer. In this patent application, the terms 'pickup tone,' 'tonal quality,' and 'sound quality' will be used interchangeably to describe the contributions of the pickup to the perceptual features of a sound generation process. This process typically includes the conversion of the sound produced by the vibrating strings of the instrument to an electronic signal that passes through one or more signal processing and amplification stages before being converted to sound by a speaker. Because it senses string motion and generates the electronic signal that is amplified and modified by downstream components, the sound quality of a pickup plays a significant role in determining the overall tone of an amplified instrument. Sound qualities that are lost in the process of string vibration sensing are typically lost to subsequent stages of the signal processing and amplification process.

According to R. M French in the chapter of *Engineering the Guitar, Theory and Practice* entitled "Sound Quality" (pp 180-207, Springer, New York, 2009), "few topics are more controversial than sound quality. Skilled players and experienced listeners generally agree on subjective rankings of instruments, but the differences are notoriously difficult to measure and to describe using objective metrics." Like flavor, artistic quality, and other variables that describe the properties of an item in terms of its effect on human perception, good sound quality and tone are readily recognized by a knowledgeable individual but impossible to completely quantify using physical measurement parameters.

Magnetic instrument pickups generate an output signal when the magnetic flux in one or more string-sensing ferromagnetic pole pieces changes in response to the motion of an instrument string. The pole pieces have magnetic fields that may be induced by an external permanent magnet or, as in the embodiments of this invention, by the magnetic pole piece components. In a typical magnetic pickup, at least a portion of the flux in the pole pieces is flux variations.

It is well-known that sound quality of a pickup with magnetic pole pieces is affected by the basic pickup design, by the number of turns, tension and winding pattern of the wire coils and by the shape, ferromagnetic properties, and magnetization state of pole pieces. Those skilled in the art typically possess a general knowledge of the tonal characteristics of common pole piece materials but a have a limited understanding of the basic physical processes that are responsible for the characteristics. While the qualitative tonal differences between two similarly-constructed pickups with different pole piece materials (Stratocaster-style single coil pickups with Alnico 3 poles and Alnico 5 poles, for example) are widely known, an understanding of these differences in terms of ferromagnetic material properties of the pole pieces, including eddy current and hysteresis loss coefficients, recoil permeability, coercivity, and residual induction, is lacking.

As a partial consequence of this knowledge gap, the prior art has failed to fully exploit the range of tonalities that can be obtained from commercially-available ferromagnetic materials. Composite pole technology, as initially disclosed in '478, utilizes a combination of two or more components with dissimilar ferromagnetic properties to engineer the integrated ferromagnetic properties of a pole piece over a wide range.

Figure 2:
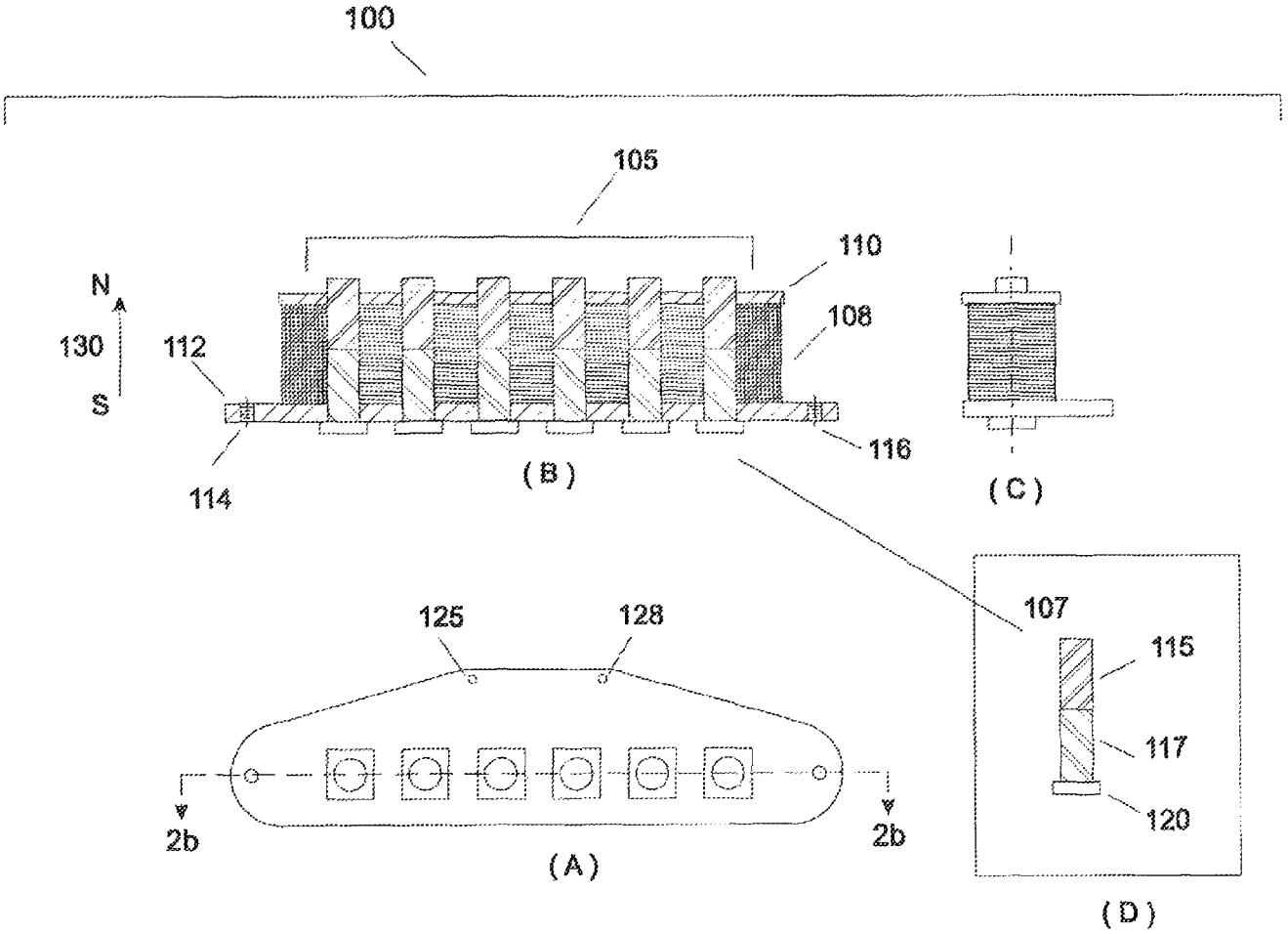
FIG. 2(A) is a bottom projection view illustrating a single coil pickup with a set of self-magnetized composite pole pieces.
FIG. 2(B) is a sectional view of the single coil pickup with a set of self-magnetized composite pole pieces taken along the line 2*b*-2*b* in FIG. 2(A).
FIG. 2(C) is a side projection view of the single coil pickup with a set of self-magnetized composite pole pieces.
FIG. 2(D) is a detailed sectional view of a composite pole piece of the single coil pickup taken along 2*b*-2*b* in FIG. 2(A).
Figure 3:
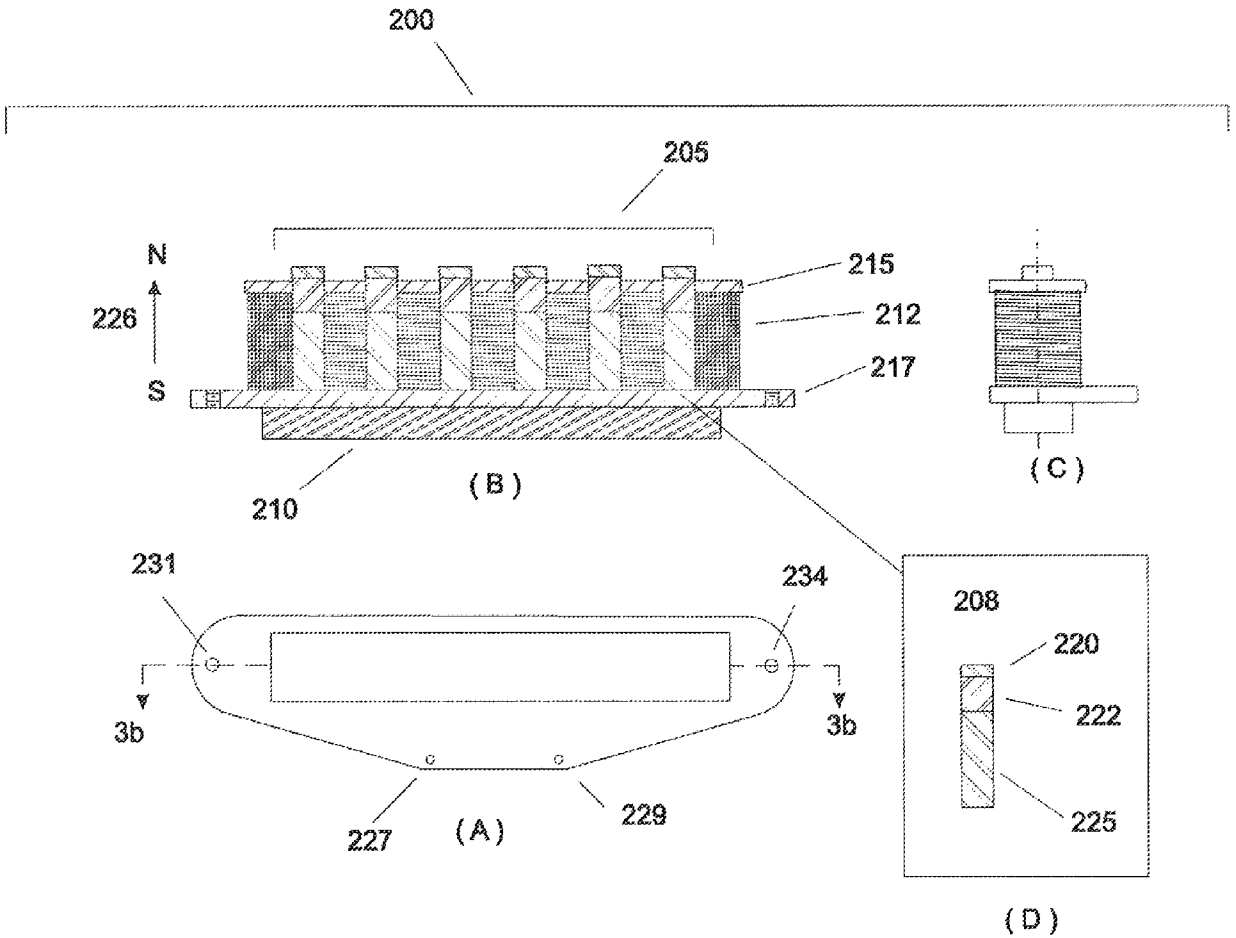
FIG. 3(A) is a bottom projection view of a single coil pickup with self-magnetized composite pole pieces and a soft ferromagnetic backplate.
FIG. 3(B) is a sectional view of the single coil pickup with self-magnetized composite pole pieces and a soft ferromagnetic backplate taken along the line 3*b*-3*b* in FIG. 3(A).
FIG. 3(C) is a side projection view of the single coil pickup with self-magnetized composite pole pieces and a soft ferromagnetic backplate.
FIG. 3(D) is a detailed sectional view of a composite pole piece of the single coil pickup taken along 3*b*-3*b* in FIG. 3(A).

FIG. 2 and FIG. 3 illustrate representative Stratocaster-style single coil pickups 100, 200 with composite pole pieces according to '478. Each of the pickups 100, 200 comprises six composite pole pieces that are self-magnetized by the inclusion of at least one permanent magnet component in each pole piece.

In the composite pole pickup 100 that is illustrated in FIG. 2, the pole pieces in the pole piece set 105 have approximately the same structures and component materials as the representative pole piece 107 that is illustrated in the inset of FIG. 2(D). Representative pole piece 107 comprises a cylindrical top component 115, a central cylindrical component 117, and a square bottom component 120. In various embodiments, at least one of the components 115,117 and 120 is formed from a hard ferromagnetic material that is magnetized as a permanent magnet and at least one of the other pole piece components is formed from a ferromagnetic material with properties that are different from the properties of the magnetized component. In a representative case, the component 115 is an Alnico 5 cylinder that is magnetized along its cylindrical axis, the component 117 is an Alnico 3 cylinder that is magnetized in the same direction as the component 115, and the component 120 is a thin square of ferritic stainless steel. The diameter of the Alnico components 115, 117 is approximately 0.187" and the lengths of the Alnico components are approximately 0.340". The stainless steel component 120 has side dimensions of 0.200" and an approximately thickness of 0.060". The components of each of the composite poles in the set are typically joined with an adhesive. Advantageously, the adhesive may be Loctite 331 manufactured by Henkel Corp. of Rocky Hill, Conn. or an alternative product that is optimized for bonding Alnico and other hard ferromagnetic materials. The Alnico 3 and Alnico 5 components of each of the pole pieces in the set 105 are fully magnetized with their magnetic fields oriented in the direction of the arrow 130.

In alternative composite pole pickups with self-magnetizing pole pieces, different pole pieces in the set 105 may have a different number of components and the components may have different sizes, shapes and compositions. The pole piece set 105 may also comprise one or more monolithic pole pieces in addition to at least one composite pole piece.

In the pickup 100, the set of pole pieces 105 is partially surrounded by a wire coil 108 that links at least a portion of the magnetic flux in the pole pieces. The pole pieces are held in stable relative position by endplates 110, 112 and threaded holes 114, 116 in the bottom endplate 112 allow the pickup 100 to be conventionally mounted in a Stratocaster or similar guitar. Suitable endplates may be fabricated from a variety of materials including Forbon and are available from several commercial suppliers. Mojo Musical Supply of Burgaw, N.C., for example, sells both Grey-bottom (Cat #2115376) and Black-bottom (Cat #2115370) flatwork sets with the correct hole dimensions and spacing.

The wire coil 108 is wound directly on the pole pieces and the windings are constrained by the endplates 110, 112. The wire coil is terminated at the output terminals 125, 128. The coil 108 typically comprises several thousand turns of insulated magnet wire that may, for example, be purchased from vendors such as MWS Wire Industries of Westlake Village, Calif. In a representative case, the coil 108 consists of approximately 8000 turns of #42 wire with heavy (2 layer) Formvar insulation. Optionally, the coil 108 may be impregnated with wax or an alternative potting compound to reduce microphonic effects.

FIG. 3 illustrates a pickup 200 in which a set 205 of self-magnetized composite pole pieces is ferromagnetically coupled to a conventional soft ferromagnetic backplate 210. Backplates are, by definition, coupled to two or more pole pieces and this feature allows them to be easily distinguished from the independent and self-contained components of a composite pole piece.

In the illustrated pickup 200, the representative pole piece 208 is illustrated in the inset of FIG. 3(D) and comprises three components 220, 222, and 225 with similar cylindrical cross sections. The top component 220 is a 1018 alloy steel pole cap with a thickness of approximately 0.030" and a diameter of approximately 0.187". Thin uppermost pole components, such as the component 220, are commonly referred to as 'pole caps' when their thicknesses are less than 0.125." The central component 222 is a 0.25" long cylinder of fully magnetized Alnico 2 and the lower component 225 is a 0.460" long cylinder of fully magnetized Alnico 5. The diameters of the cylindrical components 222, 225 are approximately 0.187".

In alternative embodiments, at least one of the cylindrical components 222, 225 is fabricated from a material with different ferromagnetic material properties than the pole cap 220 and at least one of the components 220,222 and 225 is magnetized as a permanent magnet with the polarity indicated by the arrow 226. In the pickup 200, the structure and materials of each of the pole pieces in the set 205 are approximately the same as the structure and materials of the representative pole piece 208. In other composite pole pickups, however, different pole pieces in the pole piece set 205 may have a different number of components and the components may have different sizes, shapes and compositions. The pole piece set 205 may also comprise one or more monolithic pole pieces in addition to a composite pole piece.

At least a portion of the magnetic flux in the set of pole pieces 205 is linked by a wire coil 212 that partially surrounds the pole pieces. The pole pieces in the set 205 are held in a stable position by the end plates 215 and 217. The wire coil 212 is wound directly on the pole pieces and constrained by the end plates 215 and 217. The ends of the wire coil are terminated on ferrules 227, 229 that facilitate connection of the pickup to the tone shaping circuitry in a guitar. Threaded holes 231, 234 in the bottom plate provide a means for the pickup to be mounted in a Stratocaster or similar guitar in a conventional manner.

In the pickup 200, a 430 alloy stainless steel backplate 210 is attached to the bottom endplate 217 and is ferromagnetically coupled to each of the pole pieces in the set 205 so that at least a portion of the magnetic fluxes that are generated by the pole pieces passes through the backplate 210. Soft ferromagnetic backplates are known to influence the tone of single coil pickups with self-magnetized pole pieces by increasing the inductance and eddy current losses of the magnetic circuit containing the poles, modifying the magnetic field distribution of the pickup, and, in those cases where the backplate is connected to electrical ground, shielding the pickup from sources of electromagnetic interference. Low carbon steel backplates are commonly added to conventional Telecaster bridge pickups with monolithic pole pieces and are sometimes added to Stratocaster and other single coil pickups to reduce high frequency brittleness and/or fatten the tone at midrange frequencies. Conventional soft ferromagnetic backplates are often coated with a thin layer of copper that increases the eddy current losses of the plate and facilitates the soldering of ground wires to the plate.

Figure 5:
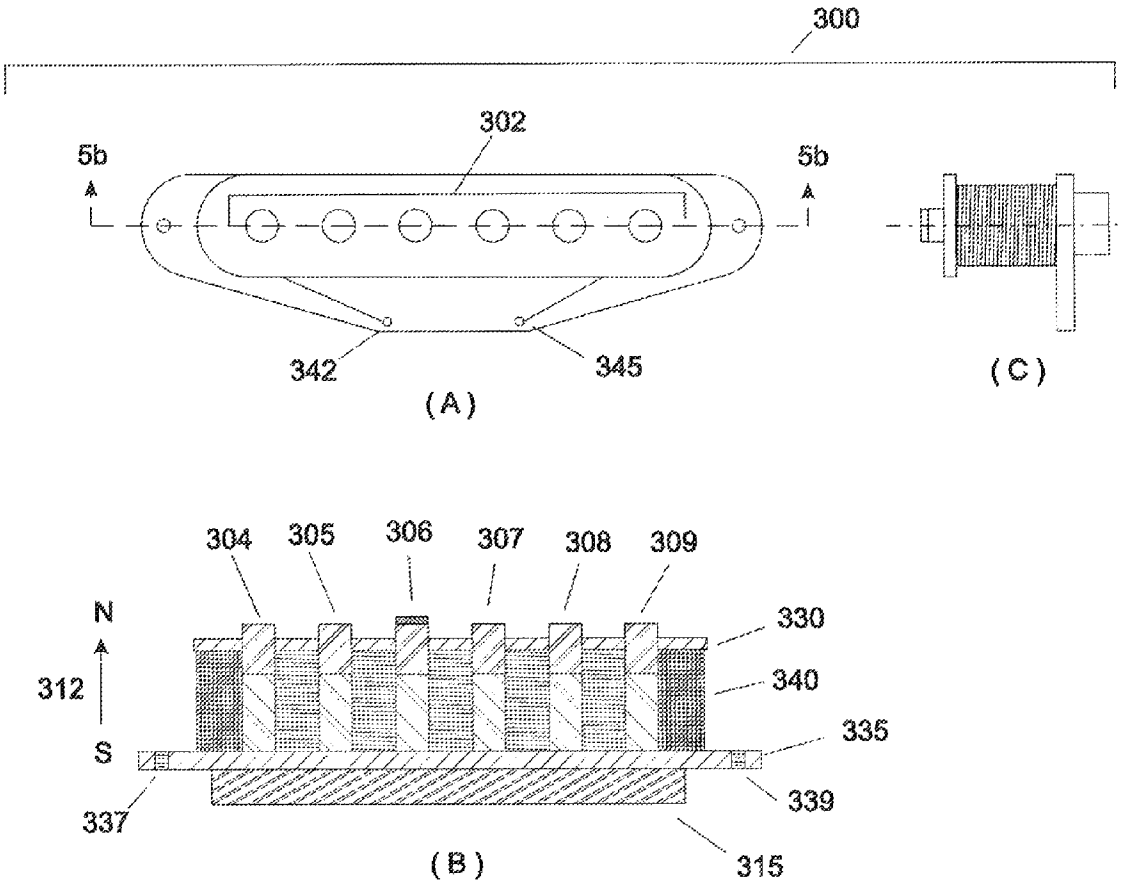
FIG. 5(A) is a top view of a pickup that comprises composite self-magnetizing pole pieces and a hard ferromagnetic backplate and embodies the present invention.
FIG. 5(B) is a sectional view of the pickup that comprises composite self-magnetized pole pieces and a hard ferromagnetic backplate taken along the line 5*b*-5*b*.
FIG. 5(C) is a side view of the pickup that comprises composite self-magnetized pole pieces and a hard ferromagnetic backplate.
Figure 6:
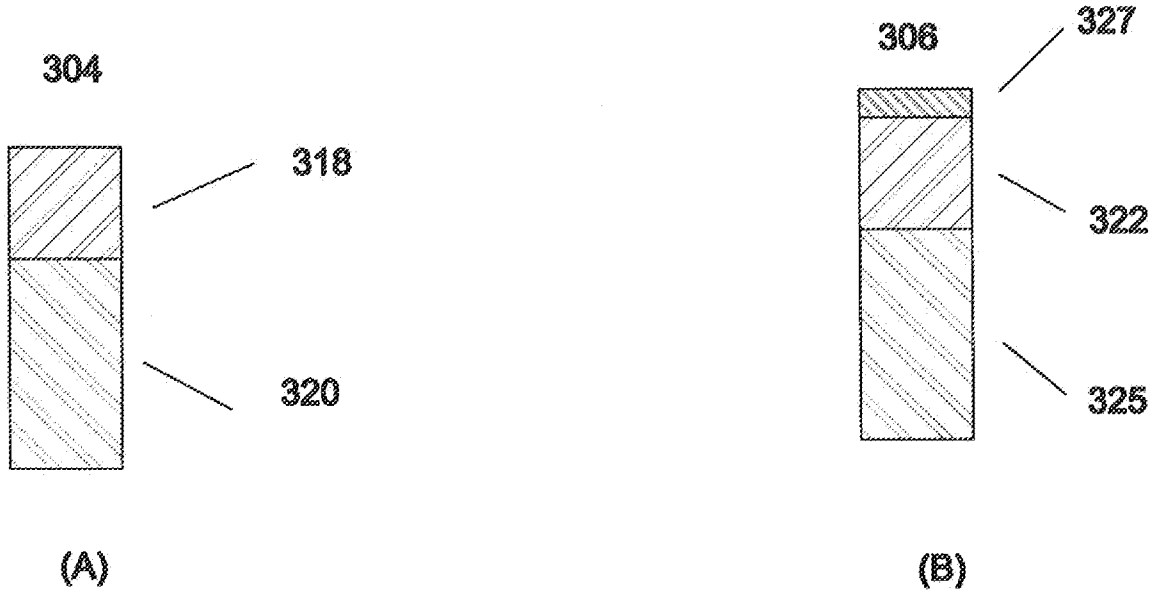
FIG. 6(A) is a sectional view of a representative composite pole piece in the pickup of FIG. 4 taken along the line 5*b*-5*b*.
FIG. 6(B) is a section view of the capped composite pole piece in the pickup of FIG. 5 taken along the line 5*b*-5*b*.

FIG. 5 and FIG. 6 illustrates a Stratocaster-style single coil pickup 300 with self-magnetizing composite pole pieces and a hard ferromagnetic backplate that embodies features of the present invention. The use of hard ferromagnetic backplates to shape the tonal properties of pickups with self-magnetized pole pieces has been extremely limited and, to the inventor's best knowledge, the Ultra Jazz bass pickup, manufactured by Dimarzio Inc. of Staten Island, N.Y. is the only prior art example of a pickup with self-magnetizing pole pieces and a hard ferromagnetic backplate. In the Ultra Jazz pickup, ceramic magnets are coupled the bottom surfaces of two sets of monolithic Alnico pole pieces to increase the magnetic flux density in the portions of the pole pieces nearest the magnets.

In certain embodiments, the present invention significantly increases the range of usable tones that can be obtained from a pickup with self-magnetizing pole pieces through the use of novel composite pole designs in combination with backplates that have one or more hard ferromagnetic components. Hard ferromagnetic backplate materials have magnetic permeabilities and loss coefficients that differ significantly from the permeabilities and losses of soft ferromagnetic materials. They may also be magnetized as permanent magnets that redirect the magnetic fields in a pickup and, in some cases, generate magnetic fields that are stronger than the fields generated by the pole pieces of a pickup.

Figure 4:
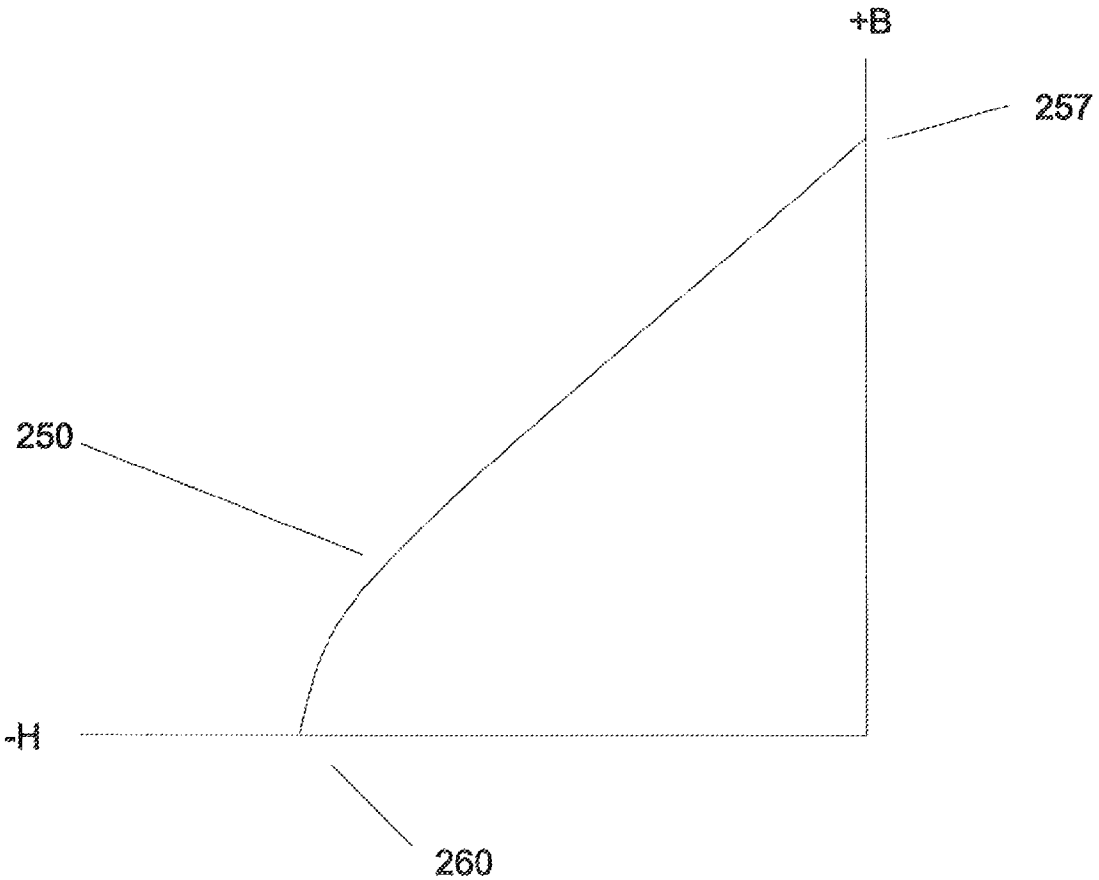
FIG. 4 illustrates the normal demagnetization curve of a representative hard ferromagnetic material.

Hard ferromagnetic materials are commonly specified in terms of their behavior in the presence of an external applied field. The graph of FIG. 4 represents the behavior of a representative hard ferrromagnetic material that has been previously magnetized to saturation by the application of a large external field (H>>0). The normal demagnetization curve 250 is a plot of the magnet flux density, B, as a function of the demagnetizing field strength, H. The intercept of the demagnetization curve with the positive B axis 257 is known as the remanance, $B_r$, and the intercept with the negative H axis 260 is known as the normal coercivity, $H_c$. Hard ferromagnetic materials with normal coercivities, $H_c$, that are greater than or equal to 100 Oersteds and less than or equal to 1000 Oersteds are referred to as hysteresis materials in this application and possess unique ferromagnetic properties that can advantageously shape the tone of a pickup. Most of the common hard ferromagnetic pole piece materials, including Alnico 2, Alnico 3, Alnico 4, Alnico 5 and CuNiFe are hysteresis materials. The pickup 300, as illustrated in FIG. 5 and FIG. 6, is representative of invention embodiments in which a set of self-magnetized composite pole pieces is coupled to a single hard ferromagnetic backplate. FIG. 5 is a sectioned orthographic projection drawing of the pickup 300 and FIGS. 6(A) and 6(B) are sectional front views detailing the structures of two different pole pieces 304, 306. In the pickup 300, the set of composite pole pieces 302 are self-magnetized in the direction of the arrow 312 and end-coupled to an Alnico 4 backplate 315. The backplate 315 may optionally be unmagnetized or magnetized to various degrees in the direction 312 but, even when fully magnetized, the backplate's contribution to the magnetic field at the top of the pole pieces in the set 302 is small.

The structure of the composite pole pieces 304, 305, 307-309 is illustrated in FIG. 6(A) and the structure of the capped composite pole piece 306 is illustrated in FIG. 6(B). Pole pieces 304,305, 307-309 comprise an upper component 318 that is formed from Alnico 5 and a lower component 320 that is formed from Alnico 3. The capped pole piece 306 comprises an Alnico 5 component 322, and Alnico 3 component 325 and a pole cap 327 that is formed from 430 alloy stainless steel. All of the components of the pole pieces 304-309 have an approximate diameter of 0.187" and the length of the Alnico 5 components 318,322 is approximately 0.188". The Alnico 3 components 320,325 are approximately 0.500" long and the stainless steel pole cap has a thickness of approximately 0.025". The Alnico components of each of the pole pieces in the set 302 are joined with Loctite 392 or an alternative conventional adhesive and the pole cap 327 may be joined to the component 322 with a conventional adhesive, wax or mounting compound.

The pole pieces in the set 302 are pressed into holes in an upper endplate 330 and lower endplate 335. The endplates 330, 335 may be formed from a range of structural materials including phenolics, engineering plastics, and vulcanized fiber (Forbon). Threaded holes 337, 339 in the lower endplate are spaced to match the pickup mounting holes in a Stratocaster or similar guitar. Sets of Forbon endplates with predrilled holes of the appropriate diameter and spacing are available from Mojo Musical Supply of Burgaw, N.C.

The Alnico 4 backplate 315 is approximately 0.125" thick, 2.25" long and 0.50" wide. It is attached to the lower surface of the lower endplate 335 using a conventional adhesive, wax or mounting compound and, in some embodiments, a nonferromagnetic spacer plate may be placed between the backplate 315 and the endplate 335 to decrease the ferromagnetic coupling between the backplate 315 and the pole pieces in the set 302.

Magnetic flux in the set of pole pieces 302 is linked by a wire coil 340 that is wound directly on the pole pieces. The ends of the wire coil are connected to the brass eyelets 342 and 345 which function as output terminals for the pickup. The wire coil 340 is wound in a conventional fashion with several thousand turns of insulated magnet wire and may, in a representative case, comprise 8600 turns of #42 wire that is insulated with a single layer of plain enamel (PE) insulation.

In the embodiment that is illustrated in FIG. 5, the Alnico 4 backplate 315 affects the tone of the pickup 300 through mechanisms that differ substantially from the tone shaping mechanisms of soft ferromagnetic backplates. Alnico 4 has a recoil permeability that is 15 to 20 times lower than the permeability of conventional soft ferromagnetic backplate materials, a conductivity that is a approximately five times smaller than the conductivity of low carbon steel alloys, and a significant level of recoil hysteresis loss. Taken cumulatively, these properties, in combination with the domain structure and other characteristics of the Alnico 4 material, modify the tonal properties of the pickup 300 in a novel and advantageous manner.

Alnico 4 is included in the class of hard ferromagnetic materials that are collectively referred to in this application as hysteresis materials and have coercivities that are greater than or equal to 100 Oersteds and less than or equal to 1000 Oersteds. Hysteresis materials impart a characteristic warmth and liveliness to tone of the pickup that cannot be obtained from soft ferromagnetic materials or hard ferromagnetic materials with high coercivity. They include many cast and sintered Alnico alloys, such as Alnico 2, Alnico 3, Alnico 4 and Alnico 5, machinable hard ferromagnetic such as Arnochrome and CuNiFe, and a majority of the semi-hard ferromagnetic materials as described in "Semi-Hard Magnets, The important role of materials with intermediate coercivity," presented by Steve Constantinides at the Magnetics 2011 Conference, San Antonio, Tex. on Mar. 1-2, 2011. Hysteresis materials further include granular and powdered hard ferromagnetic materials with coercivities, $H_c$, in the range of 100 Oe-1000 Oe that are held together with thermoplastic and thermosetting binding materials. Suitable binding materials include, but are not limited to, epoxies, acrylic binding compounds, RTV's and nylon. These materials may additionally comprise other powdered or granulated components that are not hysteresis materials. The basic properties of hard ferromagnetic materials are detailed in several books including *Ferromagnetism* by Richard M. Bozorth (IEEE Press, Piscataway, 1951, 1978) and *Permanent Magnet Materials and their Application* by Peter Campbell (Cambridge University Press, Cambridge 1994).

Pickups with self-magnetizing pole pieces and hysteresis material backplates are unknown in the prior art and, in alternative embodiments of this invention, the composite pole pieces 304-309 of the pickup 300 may be replaced by conventional self-magnetizing monolithic pole pieces. In these embodiments, the backplate 315 is formed from a hysteresis material. Self-magnetizing monolithic pole pieces are typically formed from cast or sintered Alnico alloys but may be formed from any hard ferromagnetic material with suitable properties.

In further embodiments of the invention, the set of self-magnetized pole pieces 302 may comprise a mixture of monolithic and composite pole pieces or it may comprise composite pole pieces with different materials and structures. In all embodiments of the invention, however, self-magnetized pole pieces comprise at least one hard ferromagnetic component that is magnetized as a permanent magnet. Magnetized hard ferromagnetic pole piece materials may be formed by a number of conventional processes including casting and sintering or they may be formed by incorporating hard ferromagnetic granules into insulating binders. The loss properties of bound materials may be varied over a wide range by mixing hard ferromagnetic powders with different chemical compositions and/or mixing hard and soft ferromagnetic powders.

In further embodiments of the invention, self-magnetizing composite pole pieces may incorporate high permeability components with relative permeabilties of 100 or greater that are configured to channel a significant magnetic flux from a magnetized backplate to the top surface of the pole piece. High permeability components may be coupled to one or more magnetized backplates and are able to transfer a significant quantity of the magnetic flux generated by the backplate (s) to one or more self-magnetized pole piece components. Magnetized backplates may be formed from ceramic magnets, rare earth magnets including SmCo and NdB, cast alnico magnets and sintered alnico magnets. They may also be formed from flexible and bonded materials that incorporate rare earth or ceramic powders. Magnetic flux that is transferred from a permanent magnet backplate to a magnetized hard ferromagnetic pole component may augment the magnetic field at the top surface of the component and/or alter its ferromagnetic loss properties. In extreme cases, the flux transferred from backplate magnets may be strong enough to create saturation effects in at least a portion of a hard ferromagnetic pole piece component.

Figure 7:
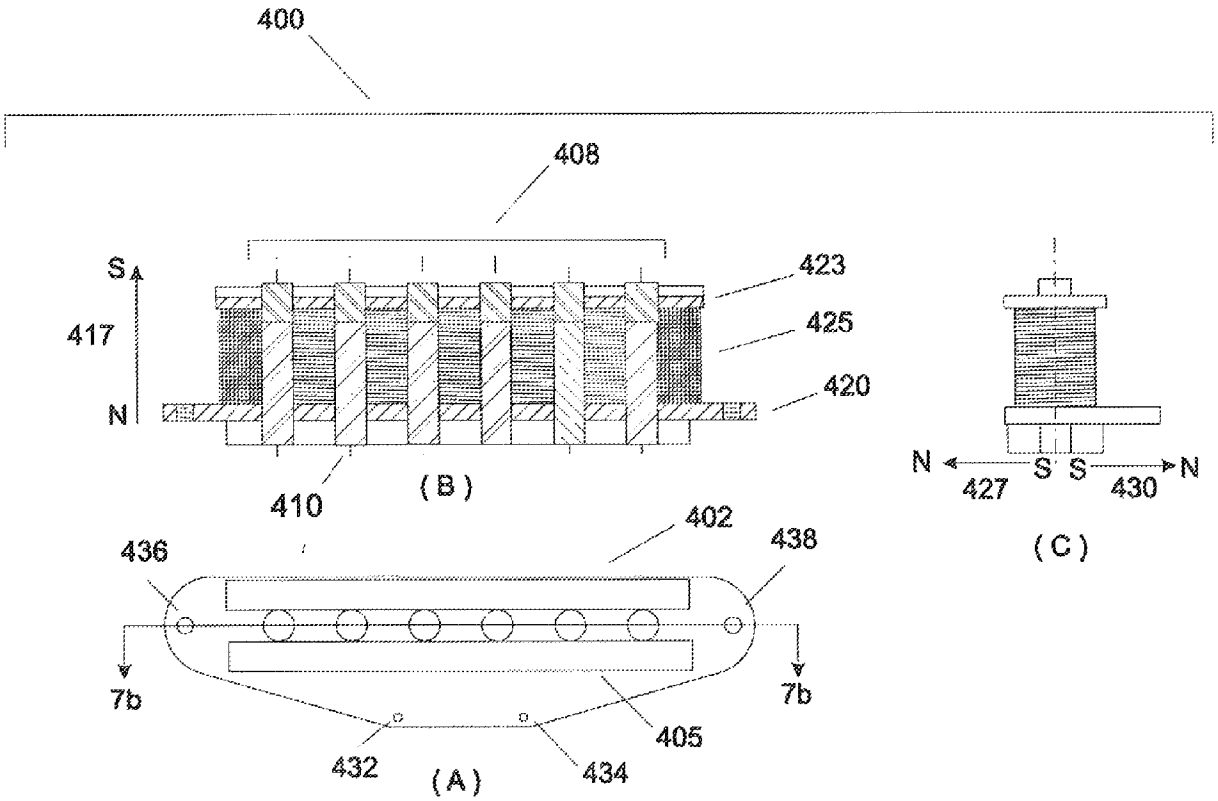
FIG. 7(A) is a bottom view of a pickup embodying the invention that comprises two magnetic backplates that are side coupled to a set of self-magnetized composite pole pieces.
FIG. 7(B) is a sectional view of the pickup comprising two magnetic backplates that are side-coupled to a set of self-magnetized composite pole pieces taken along the line 7*b*-7*b*.
FIG. 7(C) is a side view of the pickup comprising two magnetic backplates that are side-coupled to a set of self-magnetized composite pole pieces taken along the line 7*b*-7*b*.
Figure 8:
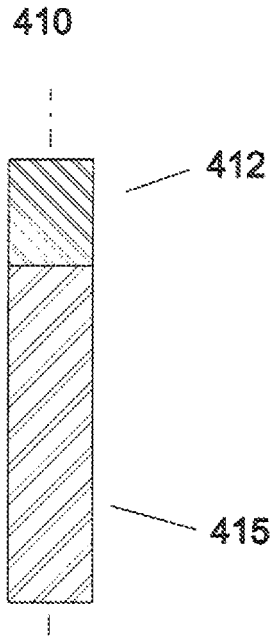
FIG. 8 is a sectional view of a pole piece in the pickup of FIG. 7 taken along the line 7*b*-7*b*.

FIG. 7 is a sectioned orthographic projection drawing that illustrates a single coil pickup 400 that has two ceramic 8 backplates 402, 405 side-coupled to the soft ferromagnetic components of set of self-magnetized composite pole pieces 408. The pole piece set 408 comprises six composite poles with the structure and dimensions of the pole piece 410 that is illustrated in the detailed front section view of FIG. 8.

The upper component, 412 and the lower component 415 of the pole piece 410 are cylinders with diameters of approximately 0.187". The upper cylinder, 412 is formed from Alnico 4, has a length of approximately 0.187" and is magnetized along its cylindrical axis with the polarity indicated by arrow 417. The lower cylinder is formed from a low carbon steel, such as 1018 alloy steel and is approximately 0.500" long. The upper and the lower components of the pole pieces in the set 408 are joined with a conventional adhesive that may advantageously be formulated for bonding Alnico alloys and other permanent magnet materials.

The composite pole pieces in the set 408 are pressed into holes in a lower Forbon endplate 420 and an upper Forbon endplate 423 and partially surrounded by a wire coil 425. The wire coil is wound in a conventional manner with approximately 8000 turns of #42 heavy Formvar wire. The ends of the coil 425 are terminated by the ferrules 432, 434 that facilitate connection to the tone circuit of a guitar. Threaded mounting holes 436, 438 in the bottom plate 420 are spaced at a distance that matches the spacing of the mounting holes in a Stratocaster or similar guitar.

The bottom ends of the composite pole pieces in the set 408 extend beyond the lower endplate 420 by approximately 0.125" and are side-coupled to the ceramic 8 magnets 402, 405. The ceramic magnets are attached to the lower endplate 420 with a conventional adhesive and are both approximately 2.35" long, 0.25" wide and 0.125" thick. The fields of the magnets 402, 405 are oriented in the directions indicated by the arrows 427, 430 so that surfaces with like polarity are coupled to the pole pieces.

In alternative embodiments of the invention, at least one of the pole pieces in the set 408 is a composite pole piece and the others may have composite or monolithic structures. The magnets 402, 405 may also be formed from alternative hard ferromagnetic materials and, in certain cases, one of the magnets may be eliminated or replaced with a soft ferromagnetic bar, or replaced with a hard ferromagnetic bar that is not magnetized.

In further embodiments, one or more of the pole pieces in the set 408, may have three or more components. One of more of the composite pole pieces in the set 408 may also have components that are all formed from low permeability materials and, in such cases, the magnets 402, 405 modify the tonal properties of one or more of the pole piece components but do little to augment the field at the upper surface of a pole piece.

The invention is further embodied in pickups that comprise two sets of self-magnetized pole pieces that are surrounded by different coils and at least one hard ferromagnetic backplate that is coupled to the pole pieces in one of the sets. The magnetic polarity of the pole piece sets and the sense of the signal propagation in the two coils are typically chosen so that noise signals in the two coils have opposite phases. Conventional two coil pickups in which the vibration of an individual strings typically gives rise to a signal in one of the coils include the P-Bass pickup that is manufactured by manufactured by Fender Musical Instrument Co. of Scottsdale, Ariz. and the Z-coil pickup manufactured by G&L of Huntington Beach, Calif.

Figure 9:
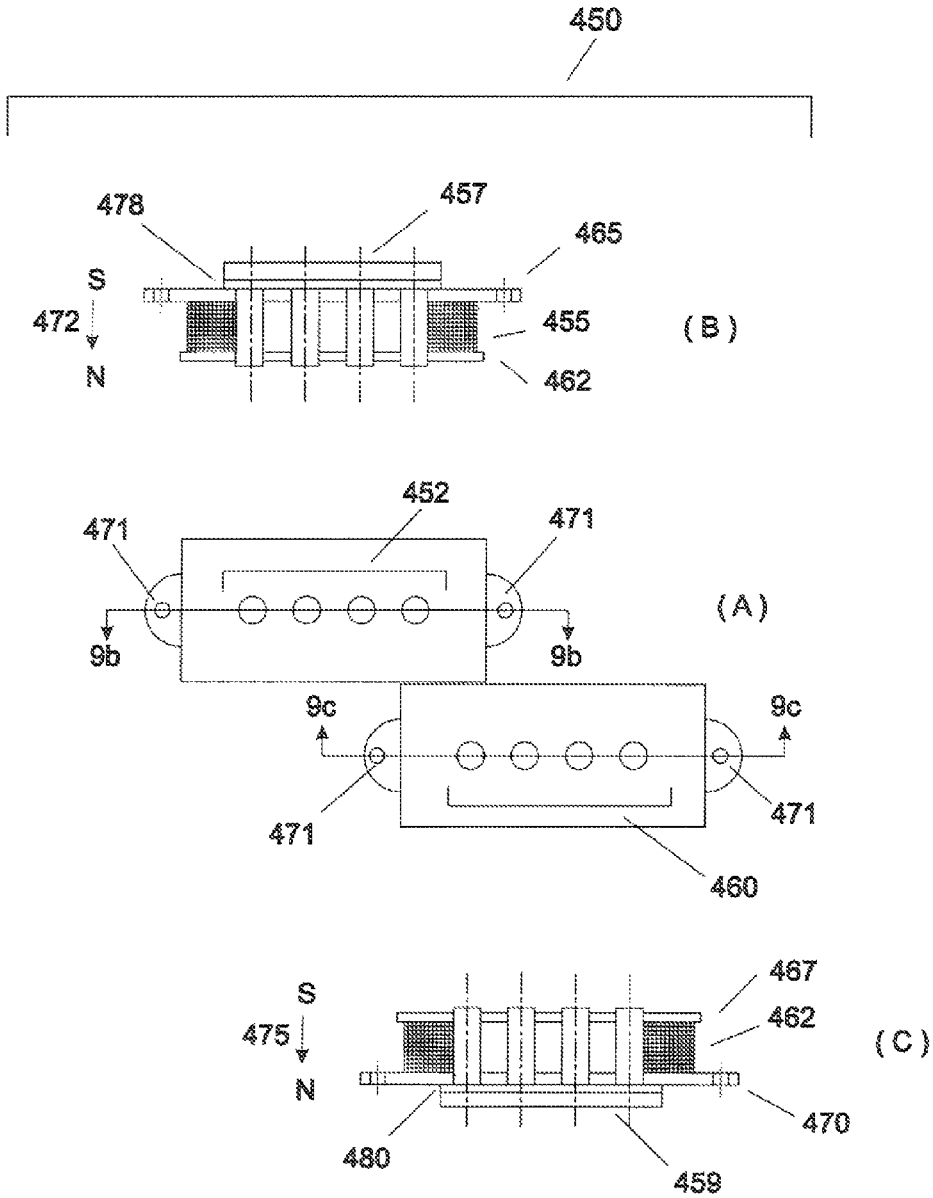
FIG. 9(A) is a top view of a P-Bass pickup with monolithic self-magnetized pole pieces and hysteresis backplates that embodies the invention.
FIG. 9(B) is a sectional view of the P-Bass pickup with monolithic self-magnetized pole pieces and hysteresis backplates taken along the line 9*b*-9*b*.
FIG. 9(C) is a sectional view of the P-Bass pickup with monolithic self-magnetized pole pieces and hysteresis backplates taken along the line 9*c*-89*c*.

FIG. 9 illustrates a P-Bass-style pickup 450 embodying aspects of the invention. The pickup 450 comprises a first set of four monolithic self-magnetized Alnico 5 pole pieces 452 that are partially surrounded by the wire coil 455 and ferromagnetically coupled to the Alnico 3 backplate 457 and a second set of four monolithic self-magnetized Alnico 5 pole pieces 460 that are partially surrounded by the wire coil 462 and ferromagnetically coupled to the Alnico 3 backplate 459. The pole pieces in the set 452 are pressed into holes in a first upper endplate 462 and a first lower endplate 465 and the pole pieces in the set 460 are similarly pressed into a second upper endplate 467 and a second lower endplate 470. Both of the lower endplates 465, 470 have holes 471 that are matched to the mounting holes in a standard P-Bass and a set of ferrules for terminating the ends of the coil and connecting the pickup to the tone circuit of a bass guitar.

The magnetic polarities of the pole pieces in the set 452 are indicated by the arrow 472 and oppose the polarities of the pole pieces in the set 460 that are indicated by the arrow 475. The endplates 462,465,467,470 may be formed, for example, from phenolic, an engineering plastic, or a vulcanized fiber such as Forbon. Suitable endplates and pole pieces are available from several manufacturers including Mojo Musical Supply of Burgaw, N.C. who offers a set of two assembled P-Bass bobbins with 0.187" dia.×0.531" long Alnico 5 pole pieces as catalog #2115397.

The Alnico 3 backplates 457, 459 have approximately equal dimensions and are 0.090" thick, 0.50" wide and 1.75" long. The backplate 457 is attached to the lower surface of the nonferromagnetic spacer 478 and the upper surface of the spacer 478 is attached to the lower surface of the first lower endplate 465. The backplate 459 is similarly attached to spacer 480 and the spacer is attached to the bottom surface of the second lower endplate 470. The spacers 478, 480 may, for example, be formed from phenolic, an engineering plastic or Forbon and attached to the backplates and lower endplates using conventional adhesives, wax or mounting compounds. In the embodiment of FIG. 9, the dimensions of the broadest surfaces of the spacers are matched to the dimensions of the backplates and their thicknesses are chosen to reduce the ferromagnetic coupling between the backplates and pole pieces to a desired level. In a representative case, the spacers 478, 480 may be 0.045" thick. In alternative P-bass embodiments, at least one of the backplates 457, 459 is formed from a hysteresis material and the other backplate may be absent or formed from a hard ferromagnetic material, a soft ferromagnetic material or a nonferromagnetic conductor.

Figure 10:
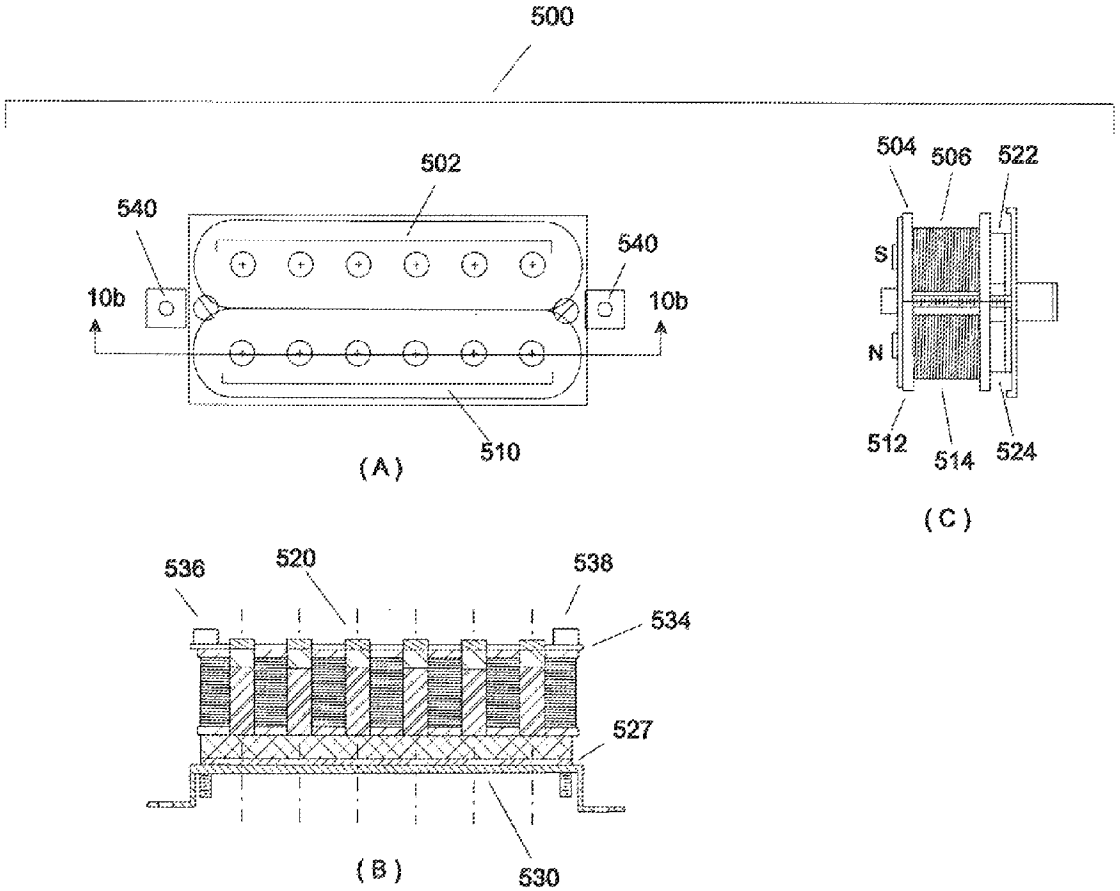
FIG. 10(A) is a top view of an MFD-style humbucking pickup that embodies the invention.
FIG. 10(B) is a sectional view of the MFD-style humbucking pickup with self-magnetized pole pieces taken along the line 10*b*-10*b*.
FIG. 10(C) is a side view of the MFD-style humbucking pickup.

In further embodiments of the invention, self-magnetized composite pole pieces and hard ferromagnetic backplates may be configured in humbucking arrangements that are similar to those disclosed in U.S. Pat. No. 2,896,491 ('491) issued to Seth Lover on Jul. 28, 1959 and U.S. Pat. No. 4,220,069 ('069) issued to C. Leo Fender on Sep. 2, 1980. FIG. 10 is a sectioned orthographic projection drawing of a noise-cancelling embodiment that is similar to the MFD humbucker of '069. In the pickup 500, a first set of 6 self-magnetized composite pole pieces 502 is supported by the insulating bobbin 504 and surrounded by a wire coil 506 that is wound on the bobbin 504. A second set of 6 self-magnetized composite pole pieces, 510 is similarly supported by the bobbin 512 and surrounded by the coil 514.

Figure 11:
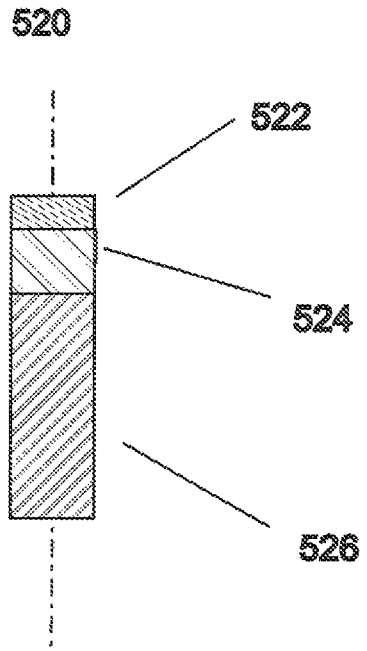
FIG. 11 is a sectional view of a pole piece in the MFD-style humbucking pickup of FIG. 10 taken along the line 10*b*-10*b*.

Each of the pole pieces in the sets 504, 510 has the structure of the representative pole piece 520 that is illustrated in the sectional front view of FIG. 11. The three components 522, 524,526 of the pole piece 520 have circular cross sections with diameters of approximately 0.187". The lowermost component 526 is a 0.312" long cylinder of music wire and the central component 524 is a 0.188" long cylinder of Alnico 5. The pole cap 522 is approximately 0.020" thick and comprises Alnico 3 grinding swarf in a 5-minute epoxy binder. The components 522, 524, 526 are joined with a conventional adhesive.

The Alnico 5 components in the pole piece set 502 are magnetized so that their upper surfaces are south poles and the Alnico 5 components of the pole pieces in the pole piece set 510 are magnetized in the opposite direction. Noise-cancellation is achieved by connecting the coils 506, 514 so that the signals propagate in opposite directions (counterclockwise and clockwise) in the two coils.

The pole pieces in the set 502 are end-coupled to a ceramic 8 magnet 531 that is magnetized through its thickness and oriented in a direction that is parallel to the magnetization direction of the Alnico 5 components of the pole pieces in the set. The pole pieces in the set 510 are similarly end-coupled to a ceramic 8 magnet 532 that is magnetized in a direction that is approximately opposite to the magnetization direction of the magnet 520. The magnets 531, 532 are approximately 2.25" long×0.375" wide, ×0.125" thick. The faces of the magnets 531, 532 that are furthest from the pole pieces are coupled to a low carbon steel plate 527 that is approximately 0.050" thick.

The bobbins 504, 512, the magnets 531, 532 and steel plate 527 are supported by a nickel silver mounting plate 530 and held in a stable position by the nonferromagnetic cover plate 534 and two screws 536,538. The mechanical stability of the assembled pickup may be further increased by joining the mating surfaces of the bobbins, magnets, steel plate and mounting plate with a conventional adhesive. Threaded holes 540 in the legs of the mounting plate 530 facilitate mounting the pickup in a guitar.

In alternative MFD humbucking embodiments, pickups may include monolithic pole pieces and pole pieces that are not self-magnetized. In all embodiments, however pickups embodying the invention comprise at least one self-magnetized composite pole piece that is coupled to a hard ferromagnetic backplate.

Figure 12:
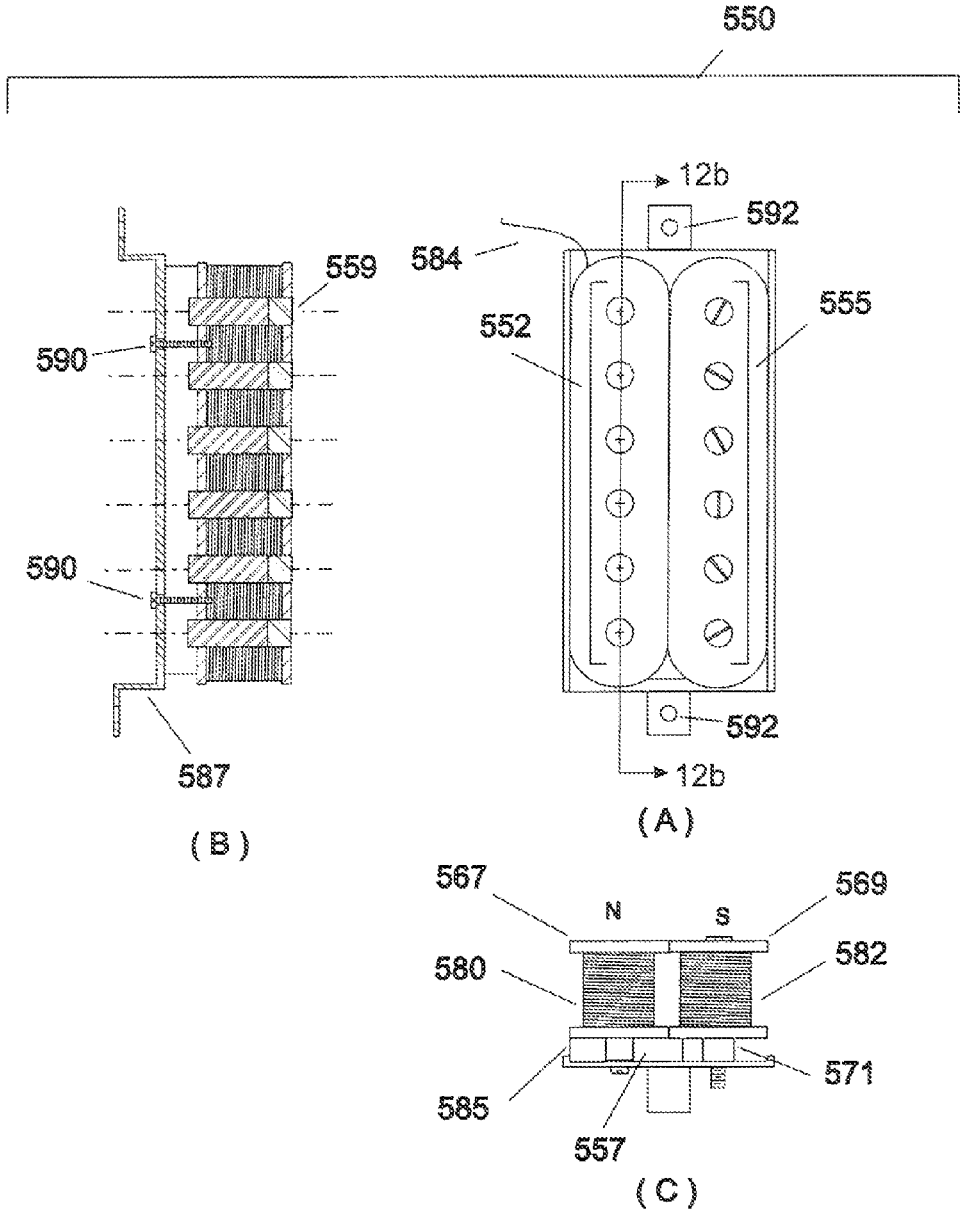
FIG. 12(A) is a top view of a Gibson-style humbucking pickup with self-magnetized pole pieces.
FIG. 12(B) is a sectional view of the Gibson-style humbucking pickup taken along the line 12*b*-12*b*.
FIG. 12(C) is a side view of the Gibson-style humbucking pickup.
Figure 13:
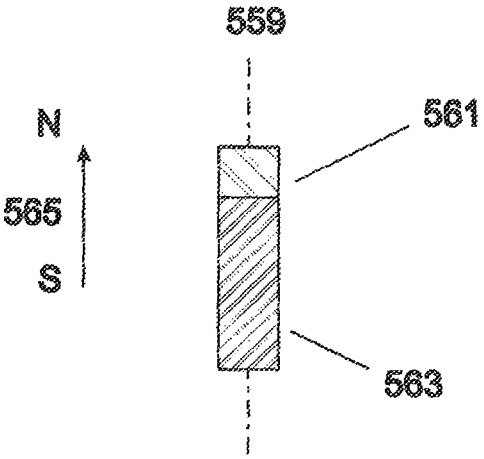
FIG. 13 is a sectional view of a self-magnetized composite pole in the Gibson-style humbucking pickup of FIG. 11 taken along the line 12*b*-12*b*.

FIG. 12 is a sectional orthographic projection drawing of a humbucking pickup 550 that is similar in design and operation to the Gibson-style humbucking pickup of '491. In the pickup 550, a set of self-magnetized composite slug poles 552 and a set of screw poles 555 are coupled to the opposite sides of a composite bar assembly 557 that comprises Alnico 5 and ceramic 7 components. The structure of the six composite slug poles in the set 552 is illustrated in sectional front view drawing of FIG. 13 and the structure of the composite bar assembly 557 is illustrated in the orthographic top view drawing of FIG. 14. In the illustration of FIG. 12, the composite slug pole 559 has an upper cylindrical component 561 that is fabricated from Alnico 4 and a lower cylindrical component 563 that is fabricated from a low carbon alloy steel such as 1010 steel. Both of the components 561, 563 have a diameter of approximately 0.187". The Alnico 4 component 561 is approximately 0.125" long and is magnetized as indicated by the arrow 565. The steel component 563 has a length of approximately 0.375" and is joined to the Alnico 4 component with a conventional adhesive.

All of the composite slug pole pieces in the set 552 have the structure and dimensions of the composite slug 559 and are supported by a conventional humbucker slug bobbin 567. The screw poles in the set 555 are formed from a low carbon steel and supported by the humbucker screw bobbin 569 and coupled to the composite magnetic bar 557 through a conventional low carbon steel keeper bar 571. Humbucker bobbins, screw poles, and keeper bars are sold by several vendors including Mojo Musical Instrument Supply of Burgaw, N.C.

Figure 14:
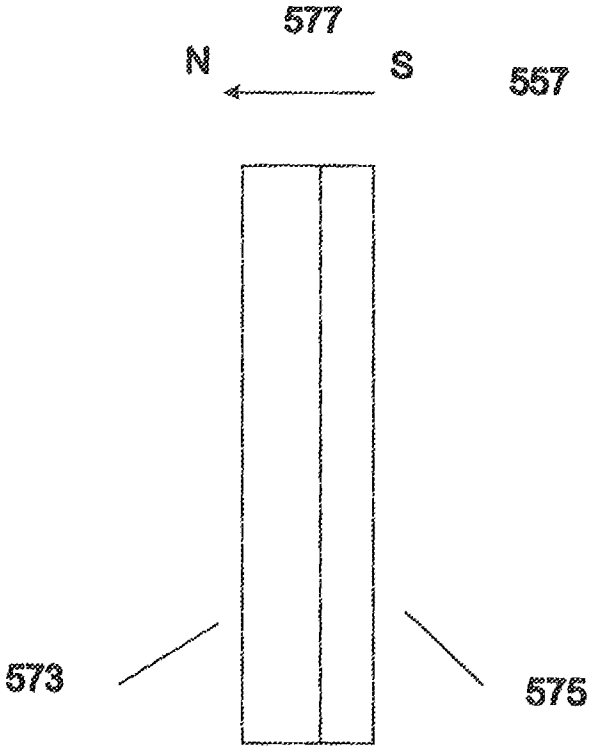
FIG. 14 is a top view of the composite hard ferromagnetic backplate in the Gibson-style humbucking pickup of FIG. 12.

The composite bar 557 that is illustrated in FIG. 14 comprises two components 573, 575 with approximate lengths of 2.25" and thicknesses of 0.125." The Alnico 5 component 573 is approximately 0.375" wide and the ceramic 7 component 575 is approximately 0.125" wide. Both of the components 573, 575 are fully magnetized in the direction of the arrow 577.

The slug poles in the set 552 are partially surrounded by the wire coil 580 and the screw poles in the set 555 are surrounded by a separate wire coil 582. The wire coils 580 and 582 are both wound with approximately 5000 turns of #42 plain enamel wire and connected to the output cable 584 in a conventional noise-cancelling configuration as described in '491.

The bobbin 567 is partially supported by a 0.125 "square× 2" long insulating bar 585 and the bobbins 567, 569 are attached to the conventional nickel silver backplate 587 with screws 590. Threaded holes 592 in the backplate 587 facilitate mounting the pickup 550 in a guitar. Suitable support bars, backplates and screw sets are available from several vendors including Mojo Musical Supply of Burgaw, N.C.

In different embodiments of the invention, the composite bar assembly 577 may be replaced by a monolithic hard ferromagnetic bar or comprise at least one hard ferromagnetic component and one or more additional components that are formed from hard or soft ferromagnetic materials. Further embodiments comprise at least one composite slug or screw pole with a magnetized hard ferromagnetic component but other poles in the sets 552, 555 may have different structures, including monolithic structures, and be formed from different materials.

In pickups according to the invention, the effect of a hard ferromagnetic backplate component on one or more of the pole pieces in a set is governed by the coupling between the pole piece and the backplate in addition to the ferromagnetic properties in the region of the backplate that is closest to the pole pieces. The coupling between a pole piece and a backplate component is dependent on their separation and can be easily reduced by increasing the distance between them. Backplates may be easily separated from a set of pole pieces by nonferromagnetic and insulating spacers that are formed, for example, from polystyrene, phenolic, Forbon or various engineering plastics.

Components in which one or more of the ferromagnetic properties is a continuous or stepped function of position may additionally be used to adjust the effect of a backplate on individual pole pieces. The ferromagnetic properties of a backplate component may be altered by varying the thickness or width of the plate or by joining the plate to other ferromagnetic or conductive components that are shaped differently from the plate. Adhesive copper foil, of the type commonly used for EMI shielding of Stratocaster pickguards, may be cut in various shapes and attached to the upper and or lower surface of a backplate component to increase eddy coil losses in the foil-covered region of the backplate.

The tonal properties of different pole pieces in a set may also be varied by coupling subsets of two or more pole pieces two different backplates. FIG. 15(A)-(C) illustrate representative configurations for coupling different backplates to subsets of the set of self-magnetizing composite pole pieces 302 of the pickup 300 that is illustrated in FIG. 4 and FIG. 5. The backplates configurations that are illustrated in FIG. 15(A)-(C) may be used in place of the backplate 315 in the pickup 300. At least one of the backplates in each of the configurations is formed from a hard ferromagnetic material and the other may be formed from a hard ferromagnetic material, a soft ferromagnetic material, or a nonferromagnetic conductor. In various embodiments, a nonferromagnetic insulating spacer may be inserted between a backplate and the bottom endplate of the pickup to adjust the coupling to a subset of the pole pieces. The backplates and optional spacers are attached to the bottom surface of the endplate 335 of the pickup 300 with a conventional adhesive, wax or mounting compound such as Crystalbond 509 that is manufactured by Aremco Products Inc., Valley Cottage, N.Y.

In the backplate configuration that is illustrated in FIG. 15(A), the pole pieces 304-306 comprise a first pole piece subset 602 and the pole pieces 307-309 comprise a second subset 605. An Alnico 3 backplate 608 is coupled to the pole pieces in the subset 602 and a 440 stainless steel backplate 610 is coupled to the pole pieces in the second subset 605. The Alnico 3 backplate 608 is approximately 0.125" thick and the stainless steel backplate 610 is approximately 0.060" thick. Both backplates are approximately 0.50" wide×1.125" long. In alternative embodiments, at least one of the ferromagnetic plates 608, 610, is fabricated from a hard ferromagnetic material and the other may be fabricated from a hard ferromagnetic material, a soft ferromagnetic material or a nonferromagnetic conductor.

FIG. 15(B) illustrates a further embodiment of the invention in which a first backplate 615 is coupled to a subset 617 comprising pole pieces 304-306, a second backplate 618 is coupled to a different subset 619 comprising pole pieces 308-309, and the pole piece 307 is not directly coupled to a backplate. The first backplate 615 is fabricated from Alnico 2 and the second backplate 618 is fabricated from Alnico 3. Both of the backplates 615, 618 have thicknesses that are approximately equal to 0.125" and widths that are approximately equal to 0.40". The length of the first plate 615 is approximately 1.125" and the length of the second plate 618 is approximately 0.80. " In different embodiments, at least one of the ferromagnetic plates 615, 618 is fabricated from a hard ferromagnetic material and the other backplate may be fabricated from a hard ferromagnetic material, a soft ferromagnetic material or a nonferromagnetic conductor.

Figure 15:
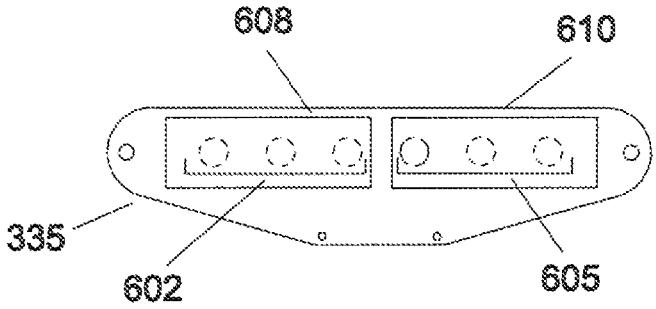
FIG. 15(A) is a bottom view of a pickup with two backplates that is similar to the pickup of FIG. 5.
FIG. 15(B) is a bottom view of a pickup with two backplates and an uncoupled pole piece that is similar to the pickup of FIG. 5.
FIG. 15(C) is a bottom view of a pickup with a rectangular backplate and a tapered backplate that is similar to the pickup of FIG. 5.
Figure 15:
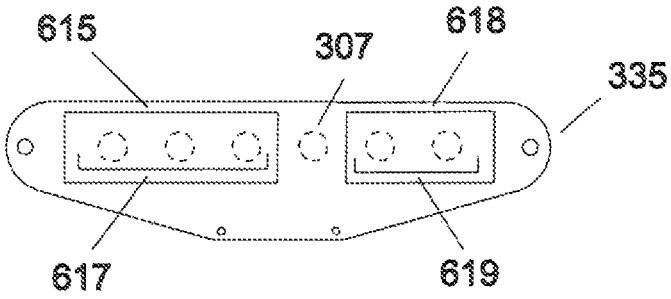
Figure 15:
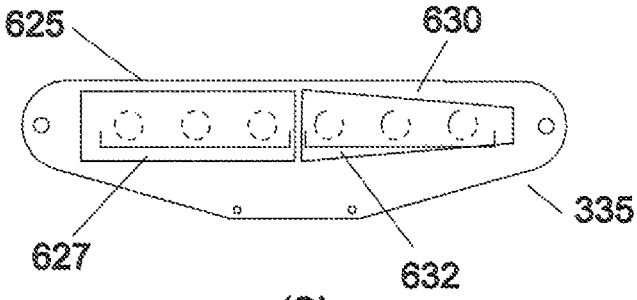

FIG. 15 (C) illustrates an embodiment of the invention in which a rectangular backplate 625 is coupled to a subset 627 comprising pole pieces 304-306 and a tapered backplate 630 is coupled to a subset 632 comprising pole pieces 307-309. In this configuration, the tapered shape of the backplate 630 causes each of the pole pieces in the set 632 to be affected differently by the plate. The rectangular plate 625 is formed from Alnico 4 and has a thickness of approximately 0.125", a width of approximately 0.500", and a length of approximately 1.125". The tapered plate 630 is formed from Alnico 3 and has a thickness and length that is approximately equal to the thickness and length of the rectangular plate 625. The width of the tapered plate has a maximum value of 0.50" and a minimum value of 0.188". In different embodiments, at least one of the ferromagnetic plates 625, 630 is fabricated from a hard ferromagnetic material and the other backplate may be fabricated from a hard ferromagnetic material, a soft ferromagnetic material or a nonferromagnetic conductor. In alternative embodiments backplates 625, 630 may have alternative shapes or different thicknesses that may be tapered in order to vary the effects of the plates on the pickup tone.

Figure 16:
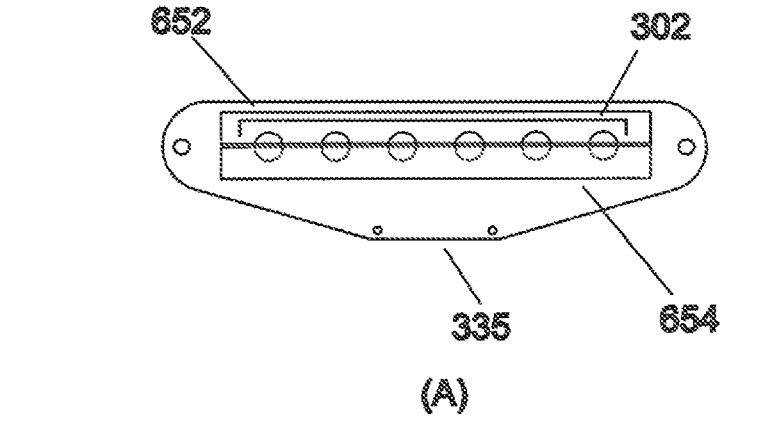
FIG. 16(A) is a bottom view of a pickup with a backplate comprising two adjacent components that is similar to the pickup of FIG. 5.
FIG. 16(B) is a bottom view of a pickup with a backplate comprising two adjacent components and a tapered backplate that is similar to the pickup of FIG. 5.
FIG. 16(C) is a bottom view of a pickup with a backplate comprising a component that is coupled to all the pole pieces and a different component that is coupled to half the pole pieces in a pickup that is similar to the pickup of FIG. 5.
Figure 16:
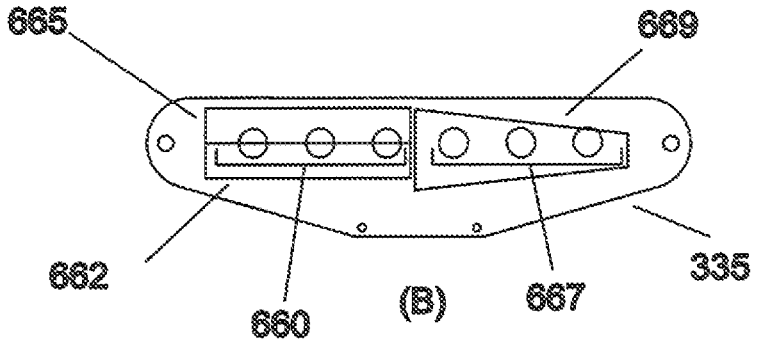
Figure 16:
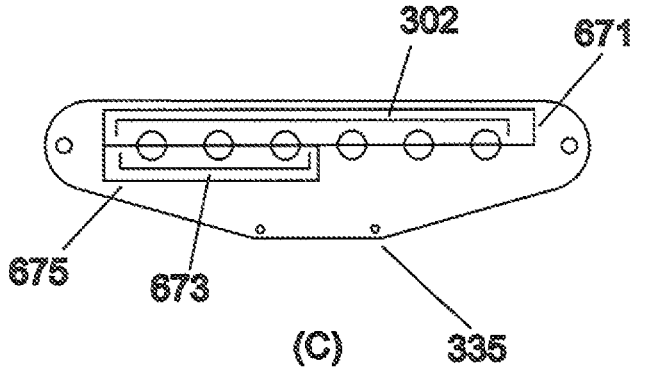
Figure 17:
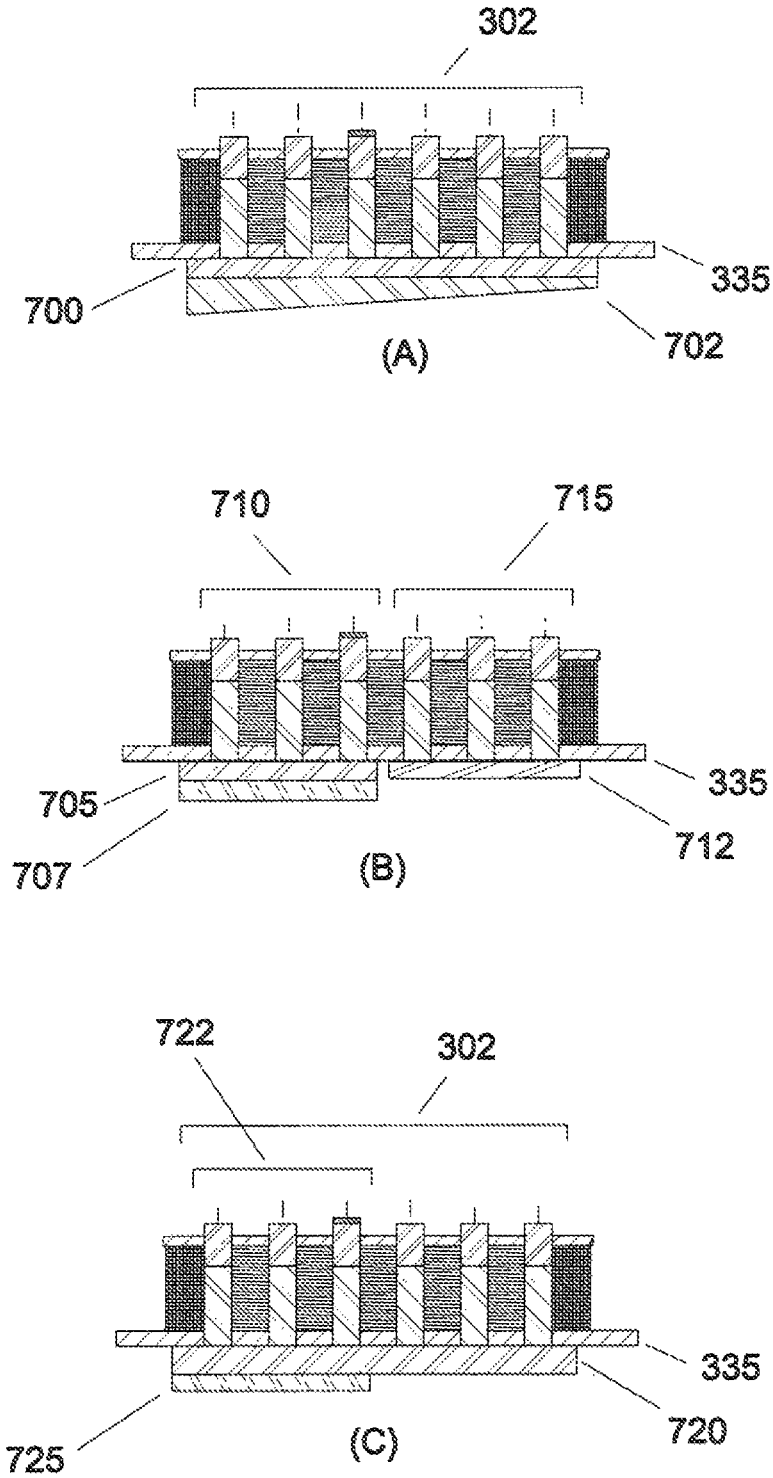
FIG. 17(A) is a front view of a pickup with a stacked backplate comprising a flat component and a wedged component that is similar to the pickup of FIG. 5.
FIG. 17(B) is a front view of a pickup with a backplate comprising two stacked components and a monolithic backplate that is similar to the pickup of FIG. 5.
FIG. 17(C) is a front view of a pickup with backplate comprising a component that is coupled to all of the pole pieces in the pickup and a stacked component that is coupled to half of the pole pieces in a pickup that is similar to the pickup of FIG. 5.

FIGS. 16(A)-(C) and FIGS. 17(A)-(C) illustrate further embodiments in which two backplate components are coupled to a single subset of the pole pieces in the pickup 300. The backplates configurations that are illustrated in FIGS. 16(A)-(C) and 17(A)-(C) may be used in place of the backplate 315 in the pickup 300. They are representative of a large class of composite plate embodiments in which two or more components with different ferromagnetic properties may be combined in a single backplate to generate ferromagnetic loss properties that cannot be obtained with a single material. In the embodiments of FIGS. 16(A)-(C) the two components are coupled to a subset of pole pieces in adjacent configurations while FIGS. 17(A)-(C) illustrate embodiments in which the two components are stacked. In each of the configurations illustrated in FIGS. 16(A)-(C) and 17(A)-(C), a nonferromagnetic insulating spacer may be inserted between a backplate and the bottom endplate 335 of the pickup 300 to adjust the coupling to a subset of the pole pieces and, in the stacked configurations of FIG. 17(A)-(C), a nonferromagentic spacer may be inserted between two stacked components. The backplates and optional spacers are attached to the bottom surface of the endplate 335 of the pickup 300 with a conventional adhesive, wax or mounting compound such as Crystalbond 509 that is manufactured by Aremco Products Inc., Valley Cottage, N.Y.

FIG. 16(A) illustrates a configuration in which all of the pole pieces in the set 302 are coupled to a backplate with two components 652, 654 that have approximately equal dimensions. The component 652 is fabricated from Alnico 3 and the component 654 is fabricated from Alnico 5. Each of the components is approximately 0.125" thick, 0.25" wide× 2.125" long and they are positioned so that a portion of each of the components 652, 654 overlaps approximately half of the bottom surface of each of the poles in the set 302. In the positions illustrated in FIG. 16(A), the spacing between the adjacent surfaces of the components 652, 654 has been minimized in order to maximize the coupling of each component to the pole pieces. In alternative embodiments, the components 652, 654 may be separated by a distance that is typically less than the diameter of the pole pieces. In further embodiments, at least one of the components 652, 654 is fabricated from a hard ferromagnetic material and the other components may be fabricated from a hard ferromagnetic material, a soft ferromagnetic material or a nonferromagnetic conductor. Alternatively, one or both of the components may comprise a granulated hard ferromagnetic material and an insulating binder and the effect of the components on the pickup tone may be varied by using component of different or variable thicknesses and/or cross sectional shapes.

FIG. 16(B) illustrates an adjacent component configuration in which pole pieces 304-306 are included in a subset 660 that is coupled to a backplate with an Alnico 3 component 662 and a component 665 that comprises iron filings in an epoxy. A second subset 667 comprising pole pieces 307-309 is coupled to a tapered Alnico 4 backplate 669. The components 662, 665 are approximately 0.125" thick×0.250 "wide×1.06" long while the Alnico 4 backplate 625 is approximately 0.060" thick, 1.06" long and has width that tapers from approximately 0.50" to 0.25".

In the configuration illustrated in FIG. 16(B) the Alnico 3 component 662 and iron-in-epoxy plate component 665 are positioned so that each plate overlaps approximately half of the lower surfaces of the pole pieces in the subset 660. In alternative embodiments, the boundary between the two components 662, 665 may be repositioned so that the coupling between one of the components 662, 665 and the pole pieces in the first subset 660 is increased at the expense of the other. The two components 662, 665 may also be separated to decrease the percentage of the lower surfaces of the pole pieces in the subset 660 that is covered by the component. Similarly, the Alnico 4 plate 669 is positioned to maximize the coupling to the pole pieces in the subset 667 in the configuration of FIG. 16(B) but, in alternative embodiments, the coupling may be reduced by positioning the plate 669 so that a portion of the lower surfaces of the pole pieces in the second set 667 uncovered.

FIG. 16(C) illustrates an adjacent component embodiment of the invention in which all of the pole pieces in the set 302 are coupled to the component 671 and a subset 673 comprising pole pieces 304-306 is additionally coupled to the component 675. In the illustrated embodiment, the component 671 is approximately 2.25" long and is formed from Alnico 3 and the component 675 is approximately 1.12" long. Both of the components have widths of approximately 0.20" and thicknesses of approximately 0.090".

In different embodiments, the coupling between Alnico 3 component 671, the Alnico 4 component 675 and the subset of pole pieces 673 may be changed by repositioning the components with respect to the bottom surfaces of the pole pieces in the subset 673 and/or separating the components so that at least a portion of bottom surfaces of the pole pieces in the subset 673 are uncovered. In cases where the Alnico 3 component 671 is repositioned, the coupling to all of the pole pieces in the set 302 may be changed.

FIG. 17(A) illustrates a stacked component configuration in which the set of self-magnetized composite pole pieces 302 in the pickup 300 is coupled to an upper Alnico 3 backplate component 700 and a wedged lower backplate component 702 that is formed from Alnico 4. The two components have widths of approximately 0.50" and lengths of approximately 2.125". The Alnico 3 component 700 has an approximately constant thickness of 0.060" and the thickness of the Alnico 4 component 702 varies from a maximum value of 0.125" to a minimum value of 0.030". Because of its wedged shape, the effect of the Alnico 4 component on the tone if the individual pole pieces in the set 302 decreases from left to right in FIG. 16(A). In alternative embodiments at least one of the components 700, 702 is formed from a hard ferromagnetic material and the other component may be formed from a soft ferromagnetic material or a nonferromagnetic conductor.

FIG. 17(B) illustrates an alternative arrangement of stacked backplates in which a first subset 710 of pole pieces that comprises pole pieces 304-306 of the pickup 300 are coupled to a backplate with two stacked components 705, 707. The component 705 is formed from Alnico 4 and the component 707 is formed from 430 alloy stainless steel. A monolithic backplate 712 is coupled to a second subset of pole pieces 715 that comprises pole pieces 307-309 of the pickup 300. The backplate 712 is formed from Alnico 3. The backplate components 705, 707 and the backplate 712 have widths of approximately 0.50" and lengths of 1.125". The thicknesses of the Alnico 4 component 705 and the Alnico 3 component 712 are approximately 0.090" and the thickness of the stainless steel plate 727 is approximately 0.030".

In alternative embodiments, the components 705, 707 and the backplate 712 may be fabricated from a range of materials including materials that comprise granulated or powdered ferromagnetic materials and an insulating binder. In each embodiment at least one of the components 705, 712 or the backplate 712 is formed from a hard ferromagnetic material and the others may be formed from a hard ferromagnetic material, a soft ferromagnetic material or a nonferromagnetic conductor.

FIG. 17(C) illustrates an embodiment of the invention in which the set of all pole pieces 302 is coupled to the backplate component 720 and a subset 722 comprising pole pieces 304-306 of the pickup 300 are additionally coupled to the backplate component 725. In the illustrated configuration the upper component 720 is a 2.25" long×0.125 thick plate of Alnico 2 and the lower component 725 is a 1.125" long×0.020 thick plate of Arnochrome 3. The widths of the two plates are approximately equal to 0.40". In alternative embodiments, one of the backplate components 720, 725 is formed form a hard ferromagnetic material and the other component may be formed from a hard ferromagnetic material, a soft ferromagnetic material or a nonferromagnetic conductor.

In the embodiments that are illustrated in FIGS. 5, 6, and 15(A)-17(C), at least one of the composite pole pieces in the set 302 is self magnetized and coupled to a backplate with a hard ferromagnetic component. In alternative embodiments, the set 302 may comprise at least one monolithic self-magnetized pole piece that is coupled to a backplate component that is fabricated from a hysteresis material. Hard ferromagnetic components and hysteresis material components may have be in any state of magnetization and, when magnetized, they may be oriented to reinforce or oppose the fields generated by the self-magnetizing pole piece. The magnetization state of some backplate components may also vary with position so that magnitude of the magnetic fluxes that are transferred between the backplate and different pole pieces are unequal.

For purposes of clarity, the backplate configurations of FIGS. 15(A)-17(C) have been illustrated using Stratocaster-style single coil pickup 300 that is illustrated in FIG. 3 but, in other embodiments, backplates with hard ferromagnetic components may be attached to composite pole single coil pickups with many different designs including, but not limited to, Telecaster Bridge and Neck, Jaguar, Jazzmaster and Jazz-Bass. Hysteresis backplates may also be attached to conventional single coil pickups with Alnico 5 or other monolithic self-magnetizing pole pieces. In conventional Jaguar pickups, Telecaster bridge pickups and Stratocaster-style single coil pickups in which the self-magnetized pole pieces are coupled to soft ferromagnetic claws or plates, hysteresis plates are typically inserted between the pole pieces and soft ferromagnetic components.

Figure 18:
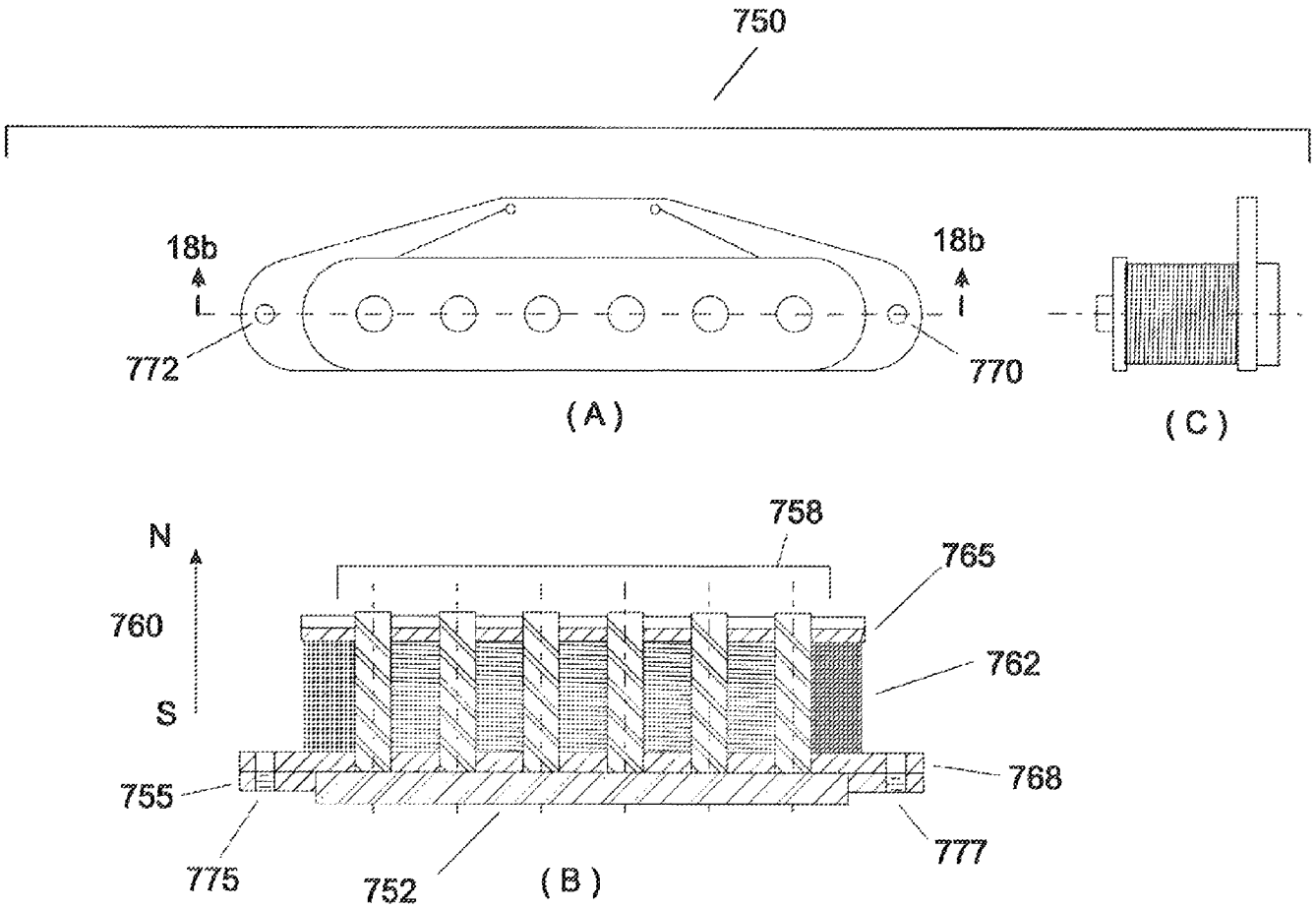
FIG. 18(A) is a top view of a pickup with monolithic poles and a removable hysteresis backplate.
FIG. 18(B) is a sectional view of the pickup with monolithic poles and a removable hysteresis backplate taken along the line 18*b*-18*b*.
FIG. 18(C) is a side view of the pickup with monolithic poles and a removable hysteresis backplate.

In further embodiments of the invention, backplates with one or more hysteresis material components may be coupled to a set of pole pieces that comprises at least one self-magnetizing pole piece in manner that facilitates removal and/or replacement of the backplate. FIG. 18 is a sectioned orthographic projection drawing of a Stratocaster-style single coil pickup 750 with a hysteresis material backplate 752 that is mounted in a threaded carrier 755. The backplate is 0.125" thick×0.25" wide×2.25" long, formed from Alnico 2, and magnetized in the direction of the arrow 760.

The six Alnico 5 pole pieces in the set 758 are approximately 0.671" long and 0.188" in diameter and magnetized as indicated by the arrow 760. The pole pieces in the set 758 are partially surrounded by a wire coil 762 that comprises approximately 8000 turns of #42 heavy Formvar wire and is wound directly on the pole pieces. The pole pieces are supported by an upper Forbon endplate 765 and a lower Forbon endplate 768. The lower endplate 768 has clearance holes 770, 772 that are approximately aligned with the threaded holes 775, 777 in the backplate carrier 755. The pickup is conventionally installed in a Stratocaster guitar by screwing the mounting screws into the threaded holes 775, 777 and the pressing the lower endplate 768 against the mounting plate 755 with sections of rubber hose or springs. This backplate mounting arrangement is similar to that used to mount soft ferromagnetic backplates to the bridge pickups in Telecaster guitars. In situations in which the pickup is exposed to its own highly amplified audio output, the carrier plate 755 and backplate 752 may be waxed or otherwise bonded to the lower endplate 768 to minimize undesirable microphonic effects.

In alternative removable endplate embodiments, the backplate 752 may be formed from alternative hysteresis materials and may comprise additional components in stacked or adjacent configurations. In those cases where the hysteresis material is machinable or comprises a powdered or granulated hysteresis material in a rigid binder, holes 775, 777 may be threaded directly into the hysteresis material backplate. The backplate 752 may also be attached directly to the endplate 768 arrangement with doubled sided tape or a repositionable adhesive.

In its various embodiments, the present invention significantly increases the range of high quality tones that can be obtained from pickups with magnetized pole pieces. While conventional pickup designs were used to illustrate key features of the invention, it will be obvious to those skilled in the magnetic pickup art that hard ferromagnetic backplates may be advantageously incorporated into any pickup with self-magnetized pole pieces.

It will be further obvious to those skilled in the art that the backplate geometries that are detailed in this specification are representative of a large number of different configurations in which one or more hard ferromagnetic backplates may be attached to a pickup. Although the subsets of poles illustrated in many of the illustrated embodiments were formed by dividing the set of pole pieces into halves, it is clear that subsets of poles in additional embodiments of the invention may contain fewer or greater than half of the poles. It is further obvious that stacked-pole embodiments may comprise hysteresis plates with three or more elements and that the maximum number of plates is primarily limited by the depth of the cavity in which the pickup will be installed. By using thin plates with thickness dimensions in the range of 0.010"-0.030", stacked configurations with 4-6 elements are feasible.

The invention claimed is:

1. A single coil magnetic pickup for detecting the vibration of the ferromagnetic strings of a musical instrument, the pickup comprising:

a set of two or more self-magnetized string-sensing pole pieces, each pole piece in the set having an upper, string-sensing surface and an opposing lower surface;

a wire coil linking a magnetic flux in all of the string sensing pole pieces in the pickup;

a ferromagnetic plate comprising a hard ferromagnetic plate component that is fabricated from a hysteresis material, the ferromagnetic plate being positioned near the lower surfaces of the pole pieces in the set of pole pieces so that at least a portion of the flux in the set of pole pieces traverses the ferromagnetic plate; and a mounting structure that holds the set of pole pieces, the coil and the ferromagnetic plate in stable relative positions and enables the pickup to be mounted on the stringed musical instrument with the string-sensing surfaces of the pole pieces in the set of pole pieces in proximal relationship to the musical instrument strings.

2. The single coil magnetic pickup of claim 1, wherein the hard ferromagnetic plate component is at least partially magnetized.

3. The single coil magnetic pickup of claim 1, wherein the hard ferromagnetic plate component comprises a hard ferromagnetic material with a coercivity of greater than or equal to 300 Oersteds and less than or equal to 1000 Oersteds.

4. The single coil magnetic pickup of claim 1, wherein the hysteresis material comprises a granulated hard ferromagnetic material with a coercivity of greater than or equal to 100 Oersteds and less than or equal to 1000 Oersteds and an insulating binder.

5. The single coil magnetic pickup of claim 1, wherein the ferromagnetic properties of the ferromagnetic plate vary with position in a plane that is approximately parallel to the lower surfaces of the pole pieces in the set of pole pieces.

6. The single coil magnetic pickup of claim 1, wherein the set of pole pieces and the first ferromagnetic plate are separated by a nonferromagnetic spacer.

7. The single coil magnetic pickup of claim 1, wherein the pole pieces in the set of pole pieces are monolithic pole pieces.

8. The single coil magnetic pickup of claim 1, wherein at least one of the pole pieces in the set of pole pieces is a composite pole piece, the composite pole piece comprising a magnetized hard ferromagnetic pole component and a second ferromagnetic pole component with ferromagnetic material properties that differ from the material properties of the hard ferromagnetic pole component.

9. The single coil magnetic pickup of claim 1, wherein the ferromagnetic plate is formed from a single, monolithic piece of the hysteresis material.

10. The single coil magnetic pickup of claim 1, wherein the ferromagnetic plate further comprises a soft ferromagnetic plate component.

11. The single coil magnetic pickup of claim 1, wherein the ferromagnetic plate further comprises an electrically conductive component that is not ferromagnetic.

12. The single coil magnetic pickup of claim 1, wherein the hard ferromagnetic plate component that is formed from a hysteresis material is essentially unmagnetized.

13. A noise-cancelling magnetic musical instrument pickup, comprising:

a first set of two or more self-magnetized string-sensing pole pieces such that the magnetic fields in each of the pole pieces in the first set of pole pieces are approximately aligned in a first direction;

a second set of one or more self-magnetized string-sensing pole pieces such that magnetic fields in each of the pole pieces in the second set of pole pieces are approximately aligned in a direction that is opposite to the first direction;

a first wire coil that is wound in a first winding direction and links magnetic flux in the first set of string sensing pole pieces;

a second wire coil that links magnetic flux in the second set of string sensing pole pieces and is connected the first wire coil so that a current passing through the first coil in the first winding direction passes through the second coil in an opposite direction;

a first ferromagnetic plate comprising a first hard ferromagnetic plate component that is fabricated from a hysteresis material, the first ferromagnetic plate being positioned near the lower surfaces of the one or more pole pieces in the first set of string sensing pole pieces so that at least a portion of the flux in the first set of pole pieces traverses the first ferromagnetic plate;

a second ferromagnetic plate comprising a second hard ferromagnetic component, the second ferromagnetic plate being positioned near the lower surfaces of the one or more pole pieces in the second set of string sensing pole pieces so that at least a portion of the magnetic flux in the second set of pole pieces traverses the second ferromagnetic plate;

a mounting structure that holds the first and second sets of pole pieces, the first and second coils, and the first and second ferromagnetic plates in stable relative positions and enables the pickup to be mounted on the stringed musical instrument with the string-sensing surfaces of the pole pieces in the first and second sets of pole pieces in proximal relationship to the musical instrument strings; and wherein the first and second sets of string-sensing pole pieces sense the motion of different groups of strings when the pickup is mounted in the musical instrument.

14. The noise-cancelling magnetic musical instrument pickup of claim 13, wherein the mounting structure comprises a single mounting plate and the first and second sets of pole pieces, the first and second coils, and the first and second ferromagnetic plates are attached to the single mounting plate.

15. The noise-cancelling magnetic musical instrument pickup of claim 13, wherein the mounting structure comprises two, spatially separated mounting plates and the first and second sets of string sensing pole pieces are attached to different mounting plates.

16. The single coil magnetic pickup of claim 1, wherein the ferromagnetic plate is a first plate and the pickup further comprises a second ferromagnetic plate, the second ferromagnetic plate comprising a hard ferromagnetic component that is positioned near the lower surfaces of the set of pole pieces so that a portion of the magnetic flux in the set of pole pieces traverses the second ferromagnetic plate.

17. A magnetic pickup for detecting the vibration of ferromagnetic strings on a musical instrument, the pickup comprising:

a first set of two or more string-sensing pole pieces comprising at least one composite pole, the composite pole comprising a magnetized component and another component with ferromagnetic properties that differ from the properties of the magnetized component and each of the pole pieces in the set of pole pieces having an upper, string-sensing surface and a lower surface;

a wire coil linking a magnetic flux in the set of pole pieces;

a first ferromagnetic plate that is mounted near the lower surfaces of the pole pieces in the first set so that at least a portion of the magnetic flux in the composite pole piece traverses the plate, the ferromagnetic plate comprising a hard ferromagnetic component; and a mounting structure that holds the set of pole pieces, the coil and the first ferromagnetic magnetic plate in stable relative positions and enables the pickup to be mounted on the stringed musical instrument with the string-sensing surfaces of the set of pole pieces in proximal relationship to the musical instrument strings.

18. The magnetic pickup of claim 17, wherein the hard ferromagnetic plate component of the first ferromagnetic plate comprises a hysteresis material.

19. The magnetic pickup of claim 17, wherein the hard ferromagnetic plate component comprises a granular hard ferromagnetic material and an insulating binder.

20. The magnetic pickup of claim 17, wherein one of the composite pole components comprises a granular ferromagnetic material with a normal coercivity that greater than or equal to 300 Oe and less than or equal to 1000 Oe and an insulating binder.

21. The magnetic pickup of claim 17, wherein the at least one composite pole piece in the set comprises a pole cap.

22. The magnetic musical instrument pickup of claim 17, wherein the pickup further comprises a second set of one or more ferromagnetic pole pieces.

23. The magnetic musical instrument pickup of claim 22, wherein the second set of one or more ferromagnetic pole pieces is at least partially surrounded by a second coil.

24. The magnetic musical instrument pickup of claim 23, wherein the magnetic poles of the pole pieces in the first and second sets of pole pieces are oppositely directed and the first and second coils are connected in a noise-cancelling configuration.

25. The magnetic musical instrument pickup of claim 22, wherein the second set of pole pieces is ferromagnetically coupled to a second ferromagnetic plate.

26. A magnetic pickup for detecting the vibration of ferromagnetic strings on a lute-type stringed musical instrument, the pickup comprising:

a set of two or more composite string-sensing pole pieces such that each pole piece in the set has an upper, string-sensing surface and a lower surface and each pole piece in the set comprises at least one magnetized ferromagnetic component;

a wire coil that links a magnetic flux in the pole pieces;

a mounting structure that holds the set of pole pieces and the coil in stable relative positions and enables the pickup to be mounted on the stringed musical instrument with the string-sensing surfaces of the set of pole pieces in proximal relationship to the musical instrument strings; and a ferromagnetic plate comprising a component that is formed from a hysteresis material, the component being removably mounted near the lower surface of the two or more pole pieces in the set so that a portion of the flux in the set of pole pieces traverses the interchangeable component of the plate.

27. The magnetic pickup of claim 26, wherein the hysteresis material component comprises a granulated hysteresis material and a binder.

* * * * *

UNITED STATES PATENT AND TRADEMARK OFFICE

CERTIFICATE OF CORRECTION

PATENT NO. : 8,907,199 B1
APPLICATION NO. : 13/725344
DATED : December 9, 2014
INVENTOR(S) : George J. Dixon It is certified that error appears in the above-identified patent and that said Letters Patent is hereby corrected as shown below:

In the Claims

Claim 6, Col. 21, line 36, "set of pole pieces and the first ferromagnetic plate are sepa-" should read -- set of pole pieces and the ferromagnetic plate are sepa- --

Signed and Sealed this
Twenty-first Day of April, 2015

Michelle K. Lee

Michelle K. Lee
*Director of the United States Patent and Trademark Office*